US007259648B2

(12) United States Patent
Matsutani et al.

(10) Patent No.: US 7,259,648 B2
(45) Date of Patent: Aug. 21, 2007

(54) MULTIPLE CHOKE COIL AND ELECTRONIC EQUIPMENT USING THE SAME

(75) Inventors: Nobuya Matsutani, Osaka (JP); Tsunetsugu Imanishi, Osaka (JP); Hidenori Uematsu, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 245 days.

(21) Appl. No.: 10/516,683

(22) PCT Filed: Dec. 11, 2003

(86) PCT No.: PCT/JP03/15858

§ 371 (c)(1),
(2), (4) Date: Dec. 6, 2004

(87) PCT Pub. No.: WO2004/055841

PCT Pub. Date: Jul. 1, 2004

(65) Prior Publication Data

US 2006/0145804 A1 Jul. 6, 2006

(30) Foreign Application Priority Data

Dec. 13, 2002 (JP) ..... 2002-362033
Dec. 13, 2002 (JP) ..... 2002-362034
Dec. 13, 2002 (JP) ..... 2002-362035
Mar. 28, 2003 (JP) ..... 2003-091172

(51) Int. Cl.
*H01F 5/00* (2006.01)

(52) U.S. Cl. ..... 336/200

(58) Field of Classification Search ..... 336/65, 336/83, 192, 200, 206–208, 232
See application file for complete search history.

(56) References Cited

U.S. PATENT DOCUMENTS 6,946,944 B2 * 9/2005 Shafer et al. ..... 336/96
6,950,006 B1 * 9/2005 Shikama et al. ..... 336/200

FOREIGN PATENT DOCUMENTS

| | | |
|---|---|---|
| JP | 1-266705 | 10/1989 |
| JP | 5-121255 | 5/1993 |
| JP | 6-77077 | 3/1994 |
| JP | 6-26221 | 4/1994 |
| JP | 6-275438 | 9/1994 |
| JP | 9-22824 | 1/1997 |

(Continued)

*Primary Examiner*—Tuyen T. Nguyen
(74) *Attorney, Agent, or Firm*—McDermott Will & Emery LLP

(57) ABSTRACT

The invention is comprised of a coil group arranging a plurality of terminal-integrated type coils (1), (4) formed by bending a metal sheet in a preset development form and having a predetermined positional relationship, and a magnetic material (7) burying therein the coil group. For example, axes of the plurality of coils (1), (4) constituting the coil group, are arranged in parallel wherein the center point of at least one coil selected from the plurality of coils (1), (4) and the center point of a coil other than the selected coil are in an staggered arrangement. Due to this, an array type choke coil can be realized which is thin overall and operable with a large current in a high frequency band.

33 Claims, 29 Drawing Sheets

FOREIGN PATENT DOCUMENTS

| | | |
|---|---|---|
| JP | 11-102816 | 4/1999 |
| JP | 11-144957 | 5/1999 |
| JP | 11-214229 | 8/1999 |
| JP | 11-273975 | 10/1999 |
| JP | 11-297543 | 10/1999 |
| JP | 2000-150269 | 5/2000 |
| JP | 2002-246242 | 8/2002 |

* cited by examiner

MULTIPLE CHOKE COIL AND ELECTRONIC EQUIPMENT USING THE SAME

This Application is a U.S. National Phase Application of PCT International Application PCT/JP03/015858.

TECHNICAL FIELD

The present invention relates to an array type choke coil for use in various electronic apparatuses and to an electronic apparatus using same, particularly a power supply apparatus.

BACKGROUND ART

In inductors such as choke coils, there is a desire for size and thickness reduction in order to cope with size and weight reduction of electronic apparatuses. For speed and integration increase in LSIs such as CPUs, the inductor is desired for use on large current at several amperes to several tens of amperes in the high frequency region.

Accordingly, there is a desire to inexpensively supply an inductor which is reduced in size and lowered in electric resistance for suppressing heat generation, reduced in loss in high-frequency region and less in inductance value lowering due to direct current superimposition even on large current.

Recently, in DC/DC converters or the like, a circuit scheme called the multi-phase scheme is adopted as a power supply circuit for achieving current increase in the high-frequency band. This circuit scheme is a scheme for sequential operation in parallel by use of a switch while phase-controlling a plurality of DC/DC converters. This scheme has a feature capable of realizing the reduction of ripple currents and increase of current in the high-frequency band with efficiency.

However, the above circuit structure solely is not necessarily sufficient in realizing the increase of current in the high-frequency band. For the choke coil for use on such a power supply circuit apparatus, size reduction and current increase in the high-frequency band is required.

In respect of such a problem, the choke coil disclosed in JP-A-2002-246242 is structured in that in a magnetic material is buried a hollow-cored coil formed by winding in a coil form a conductor wire having an insulation film such as of polyurethane. This magnetic material is made by solidifying magnetic powder whose surface is coated with two kinds or more of resin materials. The magnetic material is fitted with a metal terminal worked by bending. The hollow-cored coil and the metal terminal are electrically connected together by welding, soldering or a conductive adhesive or the like.

However, the conventional choke coil structure requires post-fixing of a metal terminal, making it difficult to reduce direct-current resistance value. Meanwhile, arranging the foregoing coils in plurality corresponding to the number of multi-phases results in an increased setup space, making size reduction difficult. Furthermore, in the case of use in multi-phase, there is a problem that characteristic cannot be fully exhibited because of inductance variation between the plurality of coils.

Meanwhile, when using in the multi-phase scheme a hollow-cored coil formed by winding in a coil form a conductor wire having an insulation film such as of polyurethane, in case a plurality of hollow-cored coils are vertically arranged in line, for example, the total height is increased thus making it impossible to reduce the thickness.

Furthermore, such a hollow-cored coil requires to increase the number of turns in order to increase the inductance value, raising a problem of size-increasing of the choke coil itself.

DISCLOSURE OF THE INVENTION

The present invention is for solving these problems, and it is an object thereof to provide an array type choke coil which is excellent in direct-current superimposition characteristic, operable on large current while securing the inductance value in high-frequency band, and capable of being reduced in size.

An array type choke coil of the present invention has a structure comprising: a coil group in which a plurality of terminal-integrated type coils formed by bending a metal sheet in a preset development form are arranged to have a set positional relationship; and a magnetic material burying therein the coil group. Due to this structure, the coil parts of a plurality of terminal integrated type coils are buried in an insulative magnetic material. Therefore, it is possible to obtain an array type choke coil favorable in characteristic in high-frequency band, small in inductance value variation and less in short circuit occurrence, and excellent in producibility.

An array type choke coil of the present invention may be structured in that the plurality of coils constituting the coil group are arranged such that the axes thereof are set the coils in parallel, and also a center point of at least one coil selected from the plurality of coils and a center point of a coil other than the selected coil are arranged to be staggered. This can realize an array type choke coil which is small in size, capable of providing a high coupling and capable of coping with a large current.

In the above structure, the structure may be such that a predetermined inductance value is obtained by changing a distance between a center point of at least one coil selected from the coil group and a center point of at least one coil selected from the plurality of coils other than the selected coil. Otherwise, the structure may be such that a predetermined inductance value is obtained by changing a height of a center point of at least one coil selected from the coil group and a center point of at least one coil selected from the plurality of coils other than the selected coil. This structure can easily realize a small-sized short-structured array type choke coil having coils equal in the number of turns but different in inductance value.

In the above structure, the structure may be such that at least one coil selected from the coil group and both coils immediately adjacent to the selected coil are in a V-form or inverted V-form arrangement, to make a direction of a magnetic flux extending through the coil caused upon flow of a current to the selected coil and a direction of a magnetic flux extending through the coil caused upon flow of a current to the both coils arranged immediately adjacent different in direction from each other. This structure can realizes an array type choke coil small in size while increasing the inductance value.

In the above structure, the structure may be such that at least one coil selected from the coil group and both coils immediately adjacent to the selected coil are in a V-form or inverted V-form arrangement, to make a direction of a magnetic flux caused upon flow of a current to the selected coil and a direction of a magnetic flux caused upon flow of a current to the both coils arranged immediately adjacent same in direction. This structure can realize an array type choke coil excellent in direct-current superimposition characteristic and structured small and short.

In the above structure, the structure may be such that the coils constituting the coil group have the number of turns of (N+0.5) turns (where N is an integer equal to or greater than 1), to provide an arrangement structure of stacking an N-turn portion of the coil selected from the coil group and an (N+0.5)-turn portion of the coil immediately adjacent to the selected coil. This structure can realize an array type choke coil structured small and short.

In the above structure, the structure may be such that a predetermined inductance value is obtained by changing respective distances between a center point of the coil selected and center points of the both coils arranged immediately adjacent. This structure can easily realize a small-sized array type choke coil equal in the number of turns of the coil but different in inductance value.

In the above structure, the structure may be such that the center points of the plurality of coils constituting the coil group are on a same plane. This can realize an array type choke coil less in inductance value variation between a plurality of coils, short in structure, and capable of coping with large current and frequency increase.

In the above structure, the structure may be such that a predetermined inductance value is obtained by changing a distance between center points of two coils immediately adjacent among the plurality of coils. This can easily realize an array type choke coil using coils equal in the number of turns but different in inductance value.

In the above structure, the structure may be such that the coil group is arranged such that magnetic fluxes in the coils caused upon flowing currents respectively to the plurality of coils alternate in direction. This can realize an array type choke coil great in inductance value due to the respective magnetic fluxes being superimposed.

In the above structure, the structure may be such that the coil group is arranged such that magnetic fluxes in the coils caused upon flowing currents respectively to the plurality of coils are same in direction. This can realize an array type choke coil excellent in direct-current superimposition characteristic because of capability of suppressing magnetic flux saturation.

The array type choke coil of the present invention is structured, in the above structure, such that the center axes of the plurality of coils constituting the coil group are arranged in parallel, distance between a center point of at least one coil selected from the plurality of coils and a center point of a coil immediately adjacent to the selected coil is a half or smaller than the sum of an outer diameter of the selected coil and a diameter of the adjacent coil, and at least one turn portion of the selected coil is arranged in a manner meshing with the adjacent coil. This structure can realize an array type choke coil small in size, capable of providing a high coupling and capable of coping with a large current.

In the above structure, the structure may be such that the selected coil and the adjacent coil have the number of turns of N turn (where N is an integer equal to or greater than 2), to provide an arrangement such that (N−1) turn portion of the selected coil is in mesh with the adjacent coil. This can realize an array type choke coil small in size, capable of providing a high coupling and capable of coping with a large current.

In the above structure, the coil group may be arranged such that a difference between an outer diameter and an inner diameter of the selected coil and a difference between an outer diameter and an inner diameter of the adjacent coil are equal, and a distance between a center point of the selected coil and a center point of the adjacent coil coincides with a half of the sum of the outer diameter of the selected coil and the inner diameter of the adjacent coil. This can realize an array type choke coil small in size, capable of providing a high coupling and capable of coping with a large current.

In the above structure, the structure may be such that a predetermined inductance value is obtained by changing a distance between a center point of at least one coil selected from the coil group and a center point of a coil adjacent to the selected coil. This can set a predetermined inductance value more freely because different inductance values can be obtained even if the coils are equal in the number of turns.

In the above structure, the coil group may be arranged such that a direction of a magnetic flux in a coil upon flow of a current to at least one coil selected from the coil group and a direction of a magnetic flux upon flow of a current to a coil adjacent the selected coil are same in direction. This can provide an excellent direct-current superimposition characteristic and a small-sized, short structure.

In the above structure, the coil group is arranged such that a direction of a magnetic flux in a coil upon flow of a current to at least one coil selected from the coil group and a direction of a magnetic flux upon flow of a current to a coil adjacent the selected coil are different. This can further increase the inductance value while keeping a small-sized form.

In the above structure, the coil group may be arranged with the plurality of coils all in line. This can control the inductance value with high accuracy.

In the above-explained array type choke coil, the structure may be such that at least one coil selected from the plurality of coils is arranged in a position deviated from a plurality of other coils arranged in line. This can further size-reduce the array type choke coil entire form because a plurality of coils can be efficiently charged and arranged within a magnetic material.

In the above-explained array type choke coil, the coil group may be arranged such that at least one of selected two or more input terminals and output terminals is arranged on the same surface in an exposed manner. This can facilitate circuit arrangement with a semiconductor integrated circuit or the like, making it easy to carry out array type choke coil mounting and operation of confirming the same.

In the above-explained array type choke coil, the structure may be such that the coil group has a plurality of coils constituting the coil group buried within the magnetic material in a longitudinal direction. This structure can provide the operation region in a high-frequency region and reduce inductance value and direct-current resistance value. Moreover, it is possible to realize an array type choke coil capable of coping with a large current and of being reduced in size.

In the above structure, a predetermined inductance value may be obtained by changing an interval of the plurality of coils. This can easily realize a desired inductance value because inductance value can be changed even with the same number of turns.

In the above structure, the coil group may be arranged such that magnetic fluxes in the coils caused upon flowing currents to the plurality of coils are in the same direction. This can reduce ripple currents.

In the above structure, the coil group may be arranged such that magnetic fluxes in the coils caused upon flowing currents to the plurality of coils alternate in direction. This can improve the direct-current superimposition characteristic.

In the above structure, the plurality of coils may have the number of turns of (N+0.5) turns (where N is an integer equal to or greater than 1), to provide an arrangement structure in that coils in upper and lower positions have respective 0.5 turn portions lying on the same plane. This can reduce the overall height.

In the above structure, at least one of all of input terminals and output terminals of the plurality of coils may be exposed in a same surface. This can improve mountability.

In the above array type choke coil, the magnetic material may be formed at least one selected from the group consisting of a ferrite magnetic material, a composite of a ferrite magnetic powder and an insulating resin and a composite of a metal magnetic powder and an insulating resin. This can reduce short circuit occurrences and realize an array type choke coil capable of coping with high-frequency band because the coil group is buried within an insulating magnetic material.

In the above array type choke coil, an insulation film may be formed on the surface of the coil. Due to this, even in case a metal sheet structuring the coil is bent and closely contacted, there is no possibility to cause short circuit between metal sheets, making possible to increase area occupation ratio.

In the above array type choke coil, the coil group may be structured having at least two terminals exposed from respective different surfaces. This can improve heat dissipation property because the terminal can be taken broad in width. Furthermore, reliability can be improved because connection strength can be increased at terminal region.

In the above array type choke coil, the coil group may be structured having at least one terminal exposed at least two surfaces: a bottom surface and the surrounding surface thereof. This can improve mounting density and reliability.

In the above array type choke coil, the coil group may have a terminal portion exposed at least in a surface, the terminal portion being constituted of an underlying layer formed of nickel (Ni) or a nickel (Ni) containing layer, and an uppermost layer formed of a solder layer or thin (Sn) layer. Due to this, soldering can be done positively and reliably.

In the above array type choke coil, the magnetic material may be provided with an indication area indicative of at least one of input terminal and output terminal. This facilitates mounting operation and inspection before/after mounting.

In the above array type choke coil, the magnetic material may be formed in a rectangular prism form. This can facilitate automated mounting.

Meanwhile, by mounting the array type choke coil on a power supply apparatus, it is possible to realize a power supply apparatus capable of being reduced in size and operating on large current. Thus, various electronic apparatus can be reduced in size and thickness.

BEST MODE FOR CARRYING OUT THE INVENTION

Figure 1:
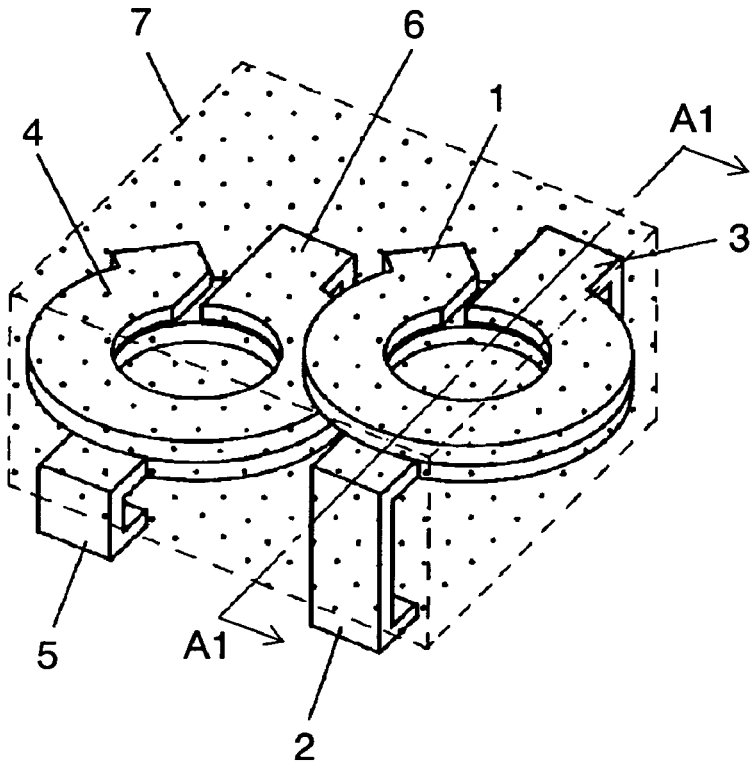
FIG. 1 is a projection perspective view of an array type choke coil according to embodiment 1 of the present invention.

Hereunder, embodiments of the present invention will be explained in detail while referring to the drawings. Note that, in the ensuing drawings, like structural elements are attached with like references and hence omitted of explanations thereof.

EMBODIMENT 1

Figure 2:
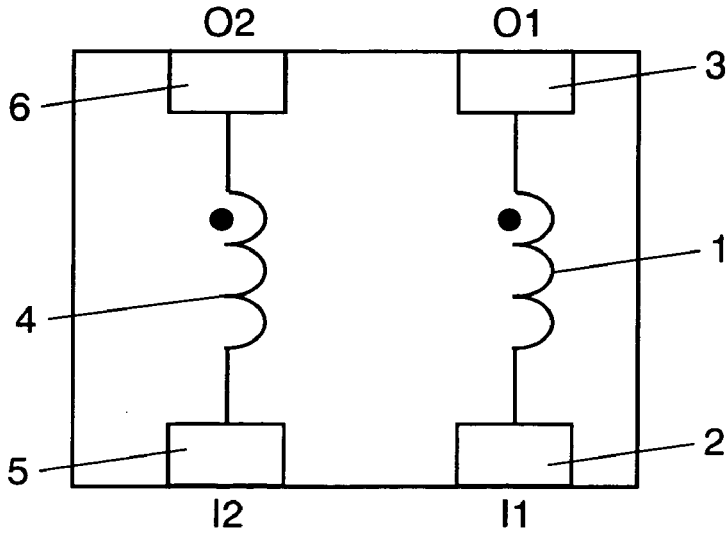
FIG. 2 is a wiring diagram of the array type choke coil according to the same embodiment.

FIG. 1 is a projection perspective view of an array type choke coil in embodiment 1 of the present invention. FIG. 2 is a wiring diagram of the array type choke coil. First coil 1 is structured by being integrally formed with input terminal 2 and first output terminal 3. Second coil 4 is also structured by being integrally formed with second input terminal 5 and second output terminal 6. First coil 1 and second coil 4 are wound in the same direction, both of which have the number of turns of 1.5 turns. Due to this, in the case of flow of a current from first input terminal 2 of first coil 1 and second input terminal 5 of second coil 4, first coil 1 and second coil 4 have in-coil magnetic fluxes assuming in the same direction.

There is provided an arrangement such that an axis of first coil 1 and an axis of second coil 4 are in parallel and wherein first coil 1 is in the upper position while second coil 4 is in the lower position. Incidentally, the respective axes refer to axes passing the center of the ring-formed coil. Because first coil 1 and second coil 4 have the same number of turns, whose center points are also different in height.

First coil 1 and second coil 4 are buried within magnetic material 7. Magnetic material 7 in the entire is formed nearly a rectangular prism form. Accordingly, the array type choke coil of the present embodiment, because nearly in a rectangular prism form in the entire, is easy to handle during automated mounting. Mistaken chucking or the like less occurs during mounting.

Figure 3:
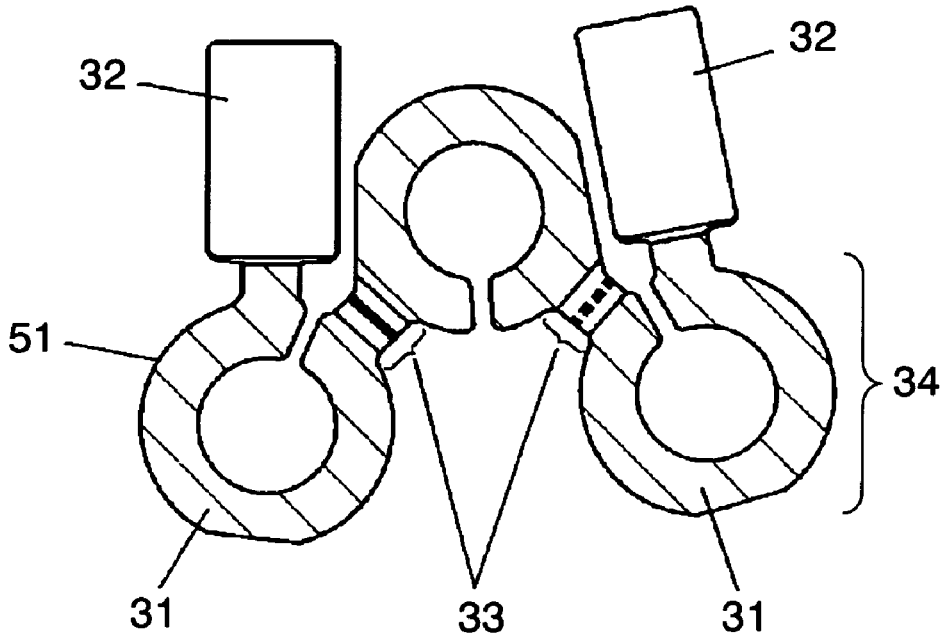
FIG. 3 is a plan view showing a form of a blanked sheet before being made into a terminal-integrated type coil to be used in the array type choke coil according to the same embodiment.
Figure 4:
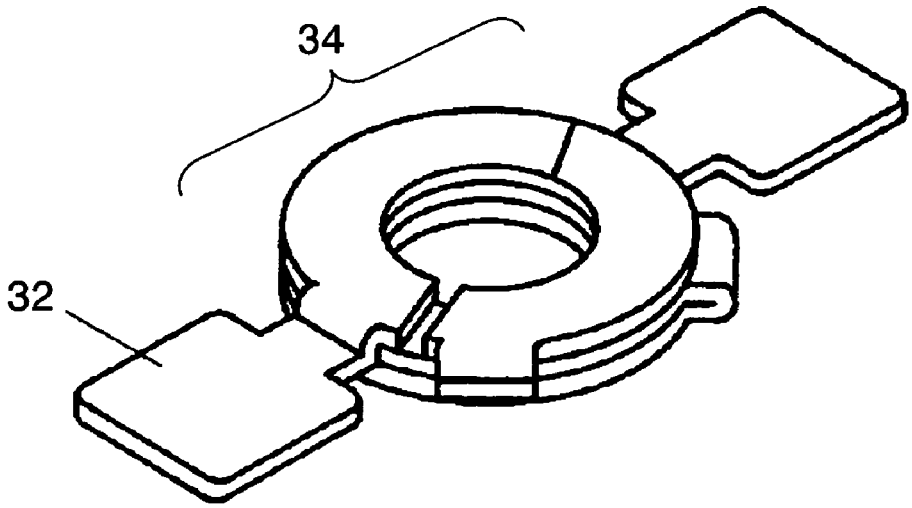
FIG. 4 is a perspective view of the terminal-integrated type coil to be used in the array type choke coil according to the same embodiment.

FIG. 3 and FIG. 4 are views for explaining a fabrication method and structure of first coil 1 and second coil 4. FIG. 3 is a plan view of a blanked sheet. FIG. 4 is a perspective view showing a state in that the same is folded and fabricated into a terminal-integrated type coil, i.e., first coil 1 and second coil 4.

Here, first coil 1 and second coil 4 is explained in concrete structure by use of FIGS. 3 and 4. First of all, explanation is made on a fabrication method and structure of a terminal-integrated type coil that is to be made into first coil 1 and second coil 4. FIG. 3 is a plan view showing a form of a blanked sheet before being formed into a terminal-integrated type coil. The blanked plate comprises three arcuate parts 31 in a ring form formed by etching or blanking a metal sheet, connections 33 joining between the arcuate parts 31 and two ends 32 extended from the two arcuate parts. As a metal plate is mainly used a material, such as copper or silver, low in electric resistance but great in thermal conductivity. The blanked sheet is not limited to the forming method based on etching or blanking, but may be formed by a working method of cutting, press-working or the like.

Insulation film 51 is formed over a surface of three arcuate parts 31. This insulation film 51 can be easily formed if applying an insulating resin, e.g., polyimide. This prevents short circuit between the coils when arcuate parts 31 are folded and vertically superimposed to form coil part 34. Because insulation film 51 is not provided on connection 33, there is no occurrence of breakage or stripping of insulation film 51 even if connection 33 is bent, thus preventing characteristic deterioration resulting from insulation film 51.

Three arcuate parts 31 of the blanked plate are bent at connection 33 such that the center points are overlapped one with another as shown in FIG. 4, thus being made into coil part 34. By bending arcuate parts 31, two ends 32 are provided radial about a center of coil part 34, thus forming a terminal-integrated coil.

Due to this, first coil 1 and second coil 4 realize a coil structure in that insulation treatment is done by insulation film 51 in coil parts 34. Accordingly, superposition is possible without providing any gap between the respective coils or between arcuate parts 31. As a result, an array type choke coil is to be realized great in area occupation ratio.

Next, magnetic material 7 can use a composite magnetic material in which, for example, a soft magnetic alloy powder is added with a silicone resin by 3.3 weight part and mixed together followed by being passed through a mesh into a regulated-particle powder. The composite magnetic material like this has a structure in that the particle of the soft magnetic alloy powder is covered by silicone resin. The soft magnetic alloy powder can use a soft magnetic alloy powder in a ratio of iron (Fe)-nickel (Ni) of 50:50 having a mean particle size of 13 μm prepared by, for example, water atomization method.

The magnetic material 7 for the array type choke coil of this embodiment used the soft magnetic alloy powder as a metal magnetic powder and the silicone resin as an insulation resin, thereby forming a composite thereof. However, this is not limitative. For example, it may be a composite of a ferrite magnetic material and an insulation resin or a composite of a metal magnetic powder other than the above and an insulation resin. Furthermore, it may be of only a ferrite magnetic material instead of a composite. Although resistance is higher than the case using a metal magnetic powder, conversely eddy currents can be prevented from occurring because of the increased resistance. Favorable characteristics is obtainable in the high frequency band.

It is possible to use a metal magnetic powder containing 90 weight percentage or more in total of iron (Fe), nickel (Ni) and cobalt (Co) in composition wherein the metal magnetic powder is at a filling ratio of 65 volume percentage to 90 volume percentage. The use of such a magnetic powder can obtain magnetic material 7 formed of a composite high in saturation magnetic flux density and in magnetic permeability. The metal magnetic powder having a mean particle size of 1 μm-100 μm is effective in reducing eddy currents.

Magnetic material 7 excellent in insulation can prevent short circuit between a plurality of coils or coil parts 34, enabling to realize highly reliable array type choke coil. Meanwhile, because the use of such magnetic material 7 can suppress an eddy current from occurring in magnetic material 7 due to flow of a current to the array type choke coil, it is possible to realize an array type choke coil capable of coping with high-frequency band. Furthermore, where a power circuit apparatus or the like is configured by use of the array type choke coil, insulation from other components, etc. can be kept.

Figure 5:
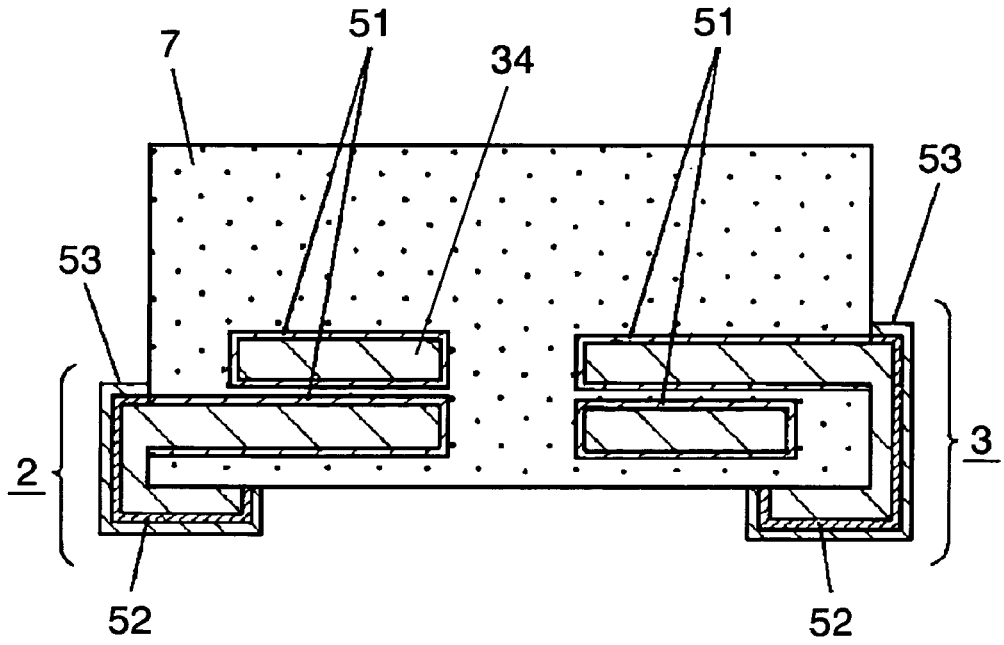
FIG. 5 is a sectional view along the line A1-A1 shown in FIG. 1 of the array type choke coil according to the same embodiment.

FIG. 5 shows a sectional view along the line A1-A1 in the array type choke coil shown in FIG. 1. Explanation is made on a method of manufacturing an array type choke coil shown in FIGS. 1 and 5 by the use of terminal-integrated type coils and magnetic material 7. At first, magnetic material 7 is placed in a metal die, to arrange two terminal-integrated type coils in a positional relationship set respectively. Thereafter, magnetic material 7 furthermore is placed in a metal die, followed by carrying out pressing. The pressure upon pressing is applied at 3 tons/$cm^2$, for example. After removal out of the metal die, heating process is conducted at 150° C. for about 1 hour, being allowed to cure. Thereafter, respective ends 32 are bent along the side surface of magnetic material 7 to the bottom, to thereby form first input terminal 2, second input terminal 5, first output terminal 3 and second output terminal 6.

Underlying layer 52 is formed on first input terminal 2, first output terminal 3, second input terminal 5 and second output terminal 6, in a part exposed out of the surface of magnetic material 7. Uppermost layer 53 is formed in a manner so as to cover underlying layer 52. Underlying layer 52 is preferably a nickel (Ni) layer, and uppermost layer 53 is preferably a solder layer or thin (Sn) layer. Incidentally, insulation film 51 is formed on the surface of coil part 34 buried in magnetic material 7.

As in the above, the solder layer as uppermost layer 52 is formed over the terminal exposed out of the surface of the array type choke coil, including the bottom thereof. This enables the array type choke coil to be positively mounted by means of a board or the like. Meanwhile, because the terminals are bent not to the side surface but to the underside of the array type choke coil, it is possible to reduce the mounting occupation area in mounting the array type choke coil onto a board or the like. Furthermore, because the terminal is formed with the Ni layer as underlying layer 52 and the solder layer as uppermost layer 53 in the present embodiment, it is possible to prevent the Ni layer from oxidizing and make solderability favorable.

In the case of an array type choke coil in the conventional structure for example, when it is used in an insufficient state of mounting of one terminal of the choke coil on the board or the like, there encounters a case in which the terminal is detached from the board or the like by heat generation or a case of occurrence of a phenomenon in which the array type choke coil is inverted from the board or the like. However, in the case of the array type choke coil of the present embodiment, because a terminal region excellent in solderability is formed over from the side surface to the bottom, such a trouble can be positively prevented from occurring.

Because first coil 1 and second coil 4 are structured by blanking and bending a metal sheet, even if used in a high frequency band, smaller direct-current resistance value and sufficient inductance value can be held and large current can be flowed as compared to the coil structured by winding a conductor wire. Meanwhile, because a sufficient inductance value can be secured without increasing the number of coil turns, it is possible to realize a small, short structured array type choke coil.

First coil 1 and second coil 4 are buried within magnetic material 7. Magnetic material 7 is excellent in insulatability. Accordingly, it is possible to prevent a trouble occurrence such as short circuit between the plurality of coils or coil parts 34. Particularly, by using a material containing at least one or more of iron (Fe), nickel (Ni) and cobalt (Co) as a main component of the metal magnetic powder for magnetic material 7, magnetic material 7 can be obtained that has a magnetic characteristic satisfying a high saturation magnetic flux density and high permeability capable of coping with a large current, thus realizing an array type choke coil having a great inductance value.

Hereunder, the operation of the gang choke coil of this embodiment is explained in the following. First coil 1 and second coil 4 are given equal in the number of turns and the same in the winding direction. Although a magnetic field is caused if flowing a current from first input terminal 2 and second input terminal 5, the magnetic fluxes extending through the respective coils are in the same direction. First coil 1 and second coil 4 are arranged to be staggered to provide a magnetic coupling.

A magnetic flux is caused by flow of a current to first coil 1. The magnetic flux constitutes a magnetic circuit extending through an in-coil center of first coil 1, to pass an outside of first coil 1 and return again to the in-coil center of first coil 1. When flowing a current to second coil 4, the magnetic flux similarly constitutes a magnetic circuit extending through an in-coil center of second coil 4, to pass an outside of second coil 4 and return again to the in-coil center of second coil 4. Because first coil 1 and second coil 4 are arranged to be staggered at this time, there is a magnetic flux superimposed over a magnetic flux of a magnetic circuit caused by flow of a current to second coil 4, of the magnetic flux of a magnetic circuit caused by flow of a current to first coil 1. Meanwhile, when flowing a current to second coil 4, there is similarly a magnetic flux superimposed over the magnetic flux of a magnetic circuit caused by flow of a current to first coil 1, of the magnetic flux of the magnetic circuit.

Due to this, coupling takes place between first coil 1 and second coil 4. Because first coil 1 and second coil 4 are arranged to be staggered, further increased is the superimposition of the magnetic flux of the magnetic circuit caused by first coil 1 and the magnetic flux of the magnetic circuit caused by second coil 4, thus realizing a high coupling.

In the case of an array type choke coil, the inductance value is influenced by a coupling of first coil 1 and second coil 4. The coupling of first coil 1 and second coil 4 changes depending upon a superimposition degree of a magnetic flux of a magnetic circuit caused by flow of a current to first coil 1 and a magnetic flux of a magnetic circuit caused by flow of a current to second coil 4. This superimposition changes depending upon an arrangement of first coil 1 and second coil 4. Consequently, in case the distance is changed between a center point of first coil 1 and a center point of second coil 4, a change is also caused in the superimposition of the magnetic fluxes. Therefore, the inductance value of the array type choke coil can be changed without changing the number of turns of first coil 1 and second coil 4. Namely, by suitably changing the distance between the center point of first coil 1 and the center point of second coil 4, a predetermined inductance value can be easily obtained.

Similarly, by changing the height of the center point of first coil 1 and the center point of second coil 4, a change is similarly caused in the superimposition of the magnetic fluxes. Accordingly, by this method, the inductance value of the array type choke coil can be also changed without changing the number of turns of first coil 1 and second coil 4. Particularly, if the coil height is changed, it is possible to readily realize more small-sized short structure.

As described above, the array type choke coil of the present embodiment can realize an array type choke coil small in size, capable of providing a high coupling and capable of coping with large current. Particularly, the array type choke coil of the present embodiment is preferably used in a power supply circuit having an arrangement in which a plurality of DC/DC converters are connected in parallel, as shown in its circuit diagram in FIG. 6.

Figure 6:
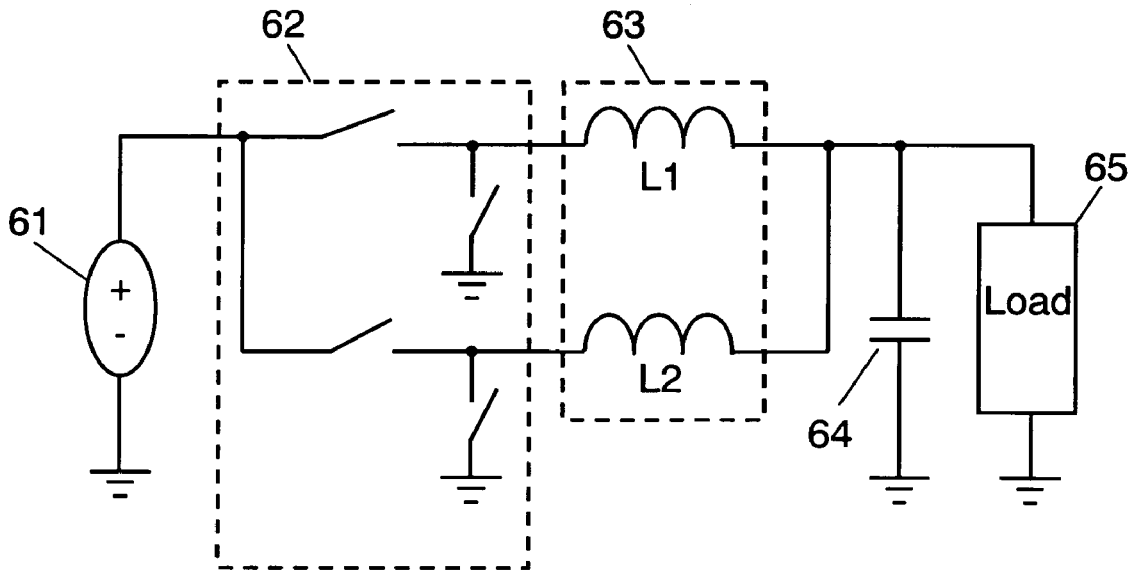
FIG. 6 is a circuit diagram of a multi-phase-schemed power supply circuit using the array type choke coil according to the same embodiment.

FIG. 6 shows a circuit diagram of a power supply circuit using a multi-phase scheme. Input power 61 is inputted to switching element 62, wherein choke coil 63 and capacitor 64 constitute an integration circuit, to connect load 65 at its output. Incidentally, 500 kHz for example is used as a switching frequency. The power supply circuit shown in FIG. 6 can realize frequency and current increase with efficiency by placing the plurality of DC/DC converters under phase control for parallel operation. However, in the conventional structure, there is a case to cause a ripple current as an output. In order to obtain a targeted direct current as an output, such ripple current is preferably as small as possible. For ripple current reduction, it is effective to increase the inductance value of choke coil 63.

Meanwhile, in order to provide a power supply circuit coping with large current, there is a need to prevent the magnetic flux of choke coil 63 from saturating when a large current flows. In order for this, the inductance value of choke coil 63 is preferably small. In case the inductance value is decreased, the direct-current superimposition characteristic of choke coil 63 can be enhanced thus making it possible to cope with greater current. Meanwhile, the above power supply circuit is assumably mounted on an electronic apparatus, e.g., a notebook personal computer, choke coil 63 is required small in size.

For this reason, the array type choke coil of the present embodiment is used as choke coil 63 for the power supply circuit shown in FIG. 6, use is possible in a high frequency band and wherein current increase can be realized with efficiency. The array type choke coil of this embodiment, because of capability of obtaining a predetermined inductance value by changing the center-point distance and height of each coil, is allowed to freely cope with the case to suppress ripple currents, the case to cope with a large current, etc.

Although the array type choke coil of the present embodiment had two terminal-integrated type coils in the gang, those may be three, four or more in the number. Those terminal-integrated type coils may be arranged in line. Alternatively, the terminal-integrated type coils arranged in line may be arranged in two rows, three rows or more on a plane, or otherwise may be in a stack arrangement. The number of turns is not limited to 1.5 turns. Furthermore, there is no especial need to provide the coils the same in the number and winding direction.

As in the above, the array type choke coil of the present embodiment can realize an array type choke coil that is small in size, capable of providing a high coupling and capable of coping with a large current, hence being effective where the array type choke coil is mounted on an electronic apparatus such as a cellular telephone.

EMBODIMENT 2

While referring to FIGS. 7 to 10, explanation is made on an array type choke coil in embodiment 2 of the present invention. The array type choke coil of the present embodiment is similar in basic structure to the array type choke coil in embodiment 1 of the present invention. However, the present embodiment is characterized in that a V-formed arrangement is provided by increasing by one the terminal-integrated type coils.

Figure 7:
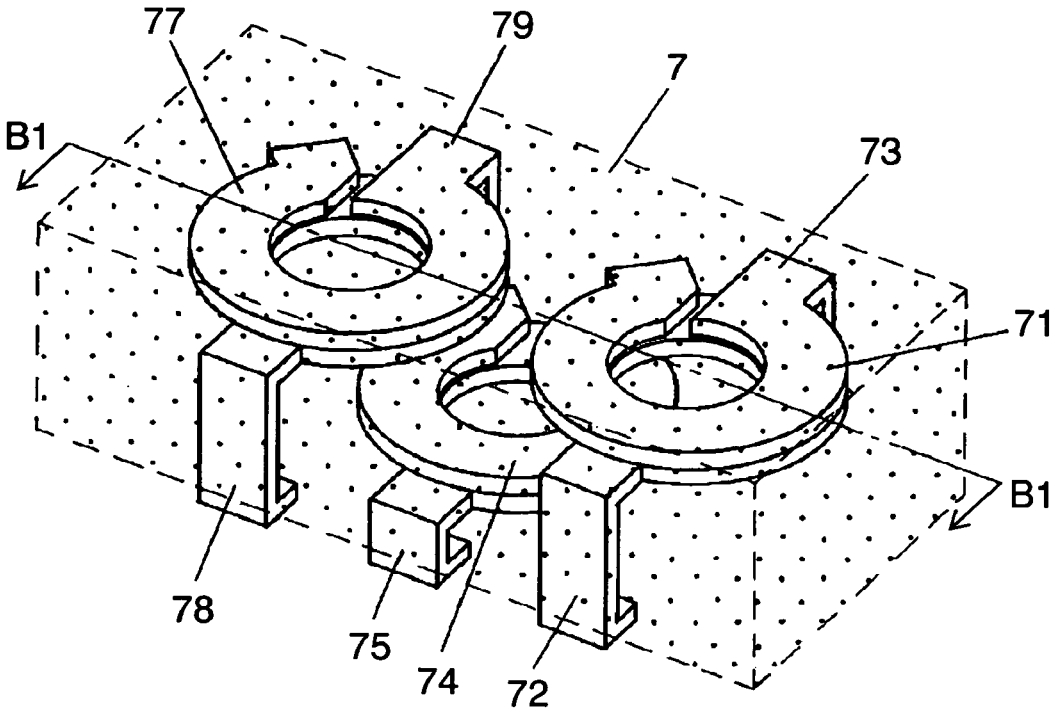
FIG. 7 is a projection perspective view of an array type choke coil according to embodiment 2 of the present invention.
Figure 8:
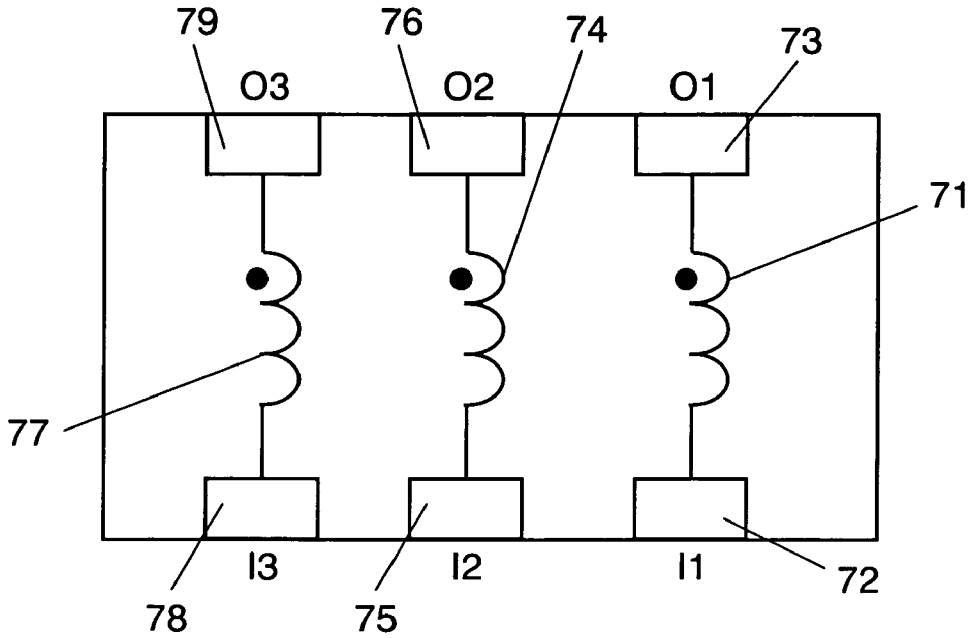
FIG. 8 is a wiring diagram of the array type choke coil according to the same embodiment.

FIG. 7 is a projection perspective view of an array type choke coil in the present embodiment. FIG. 8 is a wiring diagram of this array type choke coil. First coil 71 is formed integrally with first input terminal 72 and first output terminal 73. Second coil 74 is similarly formed integrally with second input terminal 75 and second output terminal 76. Meanwhile, third coil 77 is formed integrally with third input terminal 78 and third output terminal 79. The respective coils are wound in the same direction, all of which have the number of turns of 1.5 turns. Due to this, in the case of flowing currents to first coil 71, second coil 74 and third coil 77 through the respective input terminals, the magnetic fluxes extend through first coil 71, second coil 74 and third coil 77 are the same in direction.

Meanwhile, there is provided an arrangement such that the center axis of first coil 71, the center axis of second coil 74 and the center axis of third coil 74 are in parallel and wherein first coil 71 and third coil 77 are positioned in the upper stand while second coil 74 is positioned in the lower stand. This places first coil 71, second coil 74 and third coil 77 in a V-formed arrangement. First coil 71, second coil 74 and third coil 77 are buried within a magnetic material 7. The magnetic material 7 is formed to assume a rectangular prism. First coil 71, second coil 74 and third coil 77 are terminal-integrated type coils formed by blanking and folding a metal sheet similarly to the terminal-integrated type coils used in the array type choke coil in embodiment 1 of the present invention. The manufacturing method is the same and hence omitted of explanation.

Figure 9:
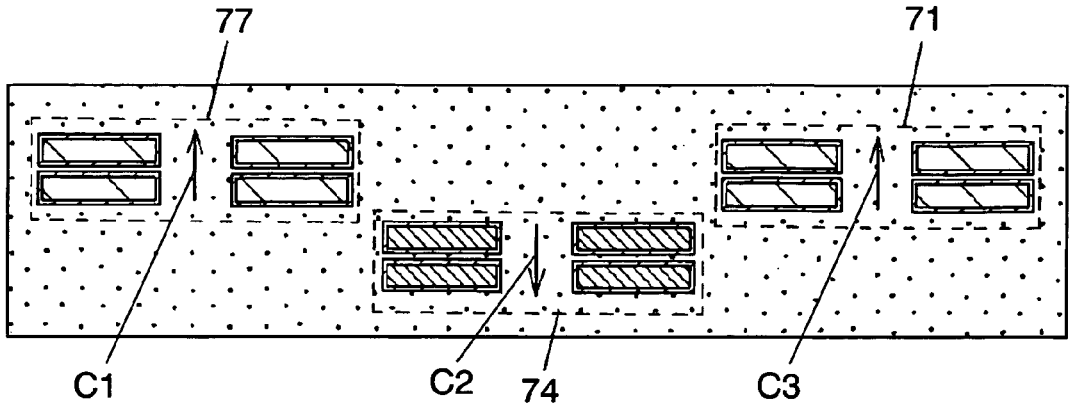
FIG. 9 is a sectional view along the line B1-B1 shown in FIG. 7 of the array type choke coil according to the same embodiment.
Figure 10:
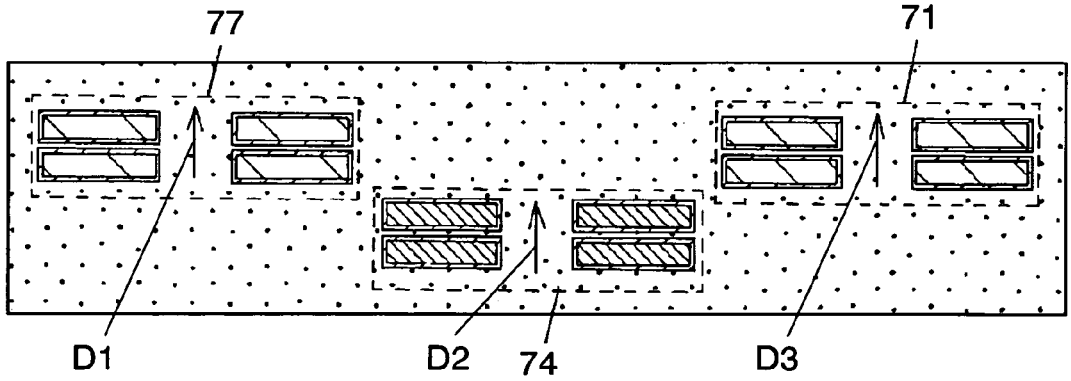
FIG. 10 is a sectional view along the line B1-B1 shown in FIG. 7 of the array type choke coil according to the same embodiment.

FIGS. 9 and 10 are sectional views along the line B1-B1 in the array type choke coil of the present embodiment shown in FIG. 7. Note that these figures are structurally the same but arrows C1, C2 C3 shown in FIG. 9 and arrows D1, D2, D3 shown in FIG. 10 are different in direction in part thereof. These arrows C1, C2, C3, D1, D2, D3 represent the directions of the magnetic fluxes extending through first coil 71, second coil 74 and third coil 77.

In the case of FIG. 9, there are shown the directions of magnetic fluxes when currents are inputted to first coil 71 and third coil 77 respectively through first input terminal 72 and third input terminal 78 while to second coil 74 through second output terminal 76. Accordingly, opposite are the direction of the magnetic flux extending through the coils of first coil 71 and third coil 77 and the direction of the magnetic flux extending through the coils of second coil 74. This state is referred to as positive coupling.

Meanwhile, in the case of FIG. 10, there are shown the directions of magnetic fluxes when currents are inputted to first coil 71, second coil 74 and third coil 77 respectively through first input terminal 72, second input terminal 75 and third input terminal 78. Accordingly, the magnetic fluxes extending respectively through the coils of first coil 71, second coil 74 and third coil 77 are the same in direction. This state is referred to as negative coupling.

The gang choke coil of the above structure is explained of its operation in the below.

In FIG. 9, in case of flowing a current to first coil 71, a magnetic flux takes place. The magnetic flux constitutes a magnetic circuit in a manner so as to extend through an in-coil center of first coil 71, to pass an outside of first coil 71 and return again to the in-coil center of first coil 71. When currents flow to second coil 74 and third coil 77, a magnetic circuit is similarly constituted. At this time, because first coil 71, second coil 74 and third coil 77 are in a V-formed arrangement, there exists a superimposed magnetic flux among the magnetic fluxes of magnetic circuits caused by flow of currents to first coil 71, second coil 74 and third coil 77. Particularly, the magnetic flux superimpositions are intensified respectively around the centers of the coils.

Namely, of the magnetic flux caused by flow of a current to first coil 71, there is a magnetic flux extending through an in-coil center of second coil 74. Likewise, of the magnetic flux caused by flowing a current to third coil 77, there is a magnetic flux extending through an in-coil center of second coil 77. Because the same are the direction of the magnetic flux extending through the in-coil center of second coil 74 and the direction of the magnetic flux extending through the in-coil center of second coil 74 upon flowing a current to second coil 74, there is an increase in the magnetic flux extending through the center of second coil 74.

Meanwhile, of the magnetic flux caused by flowing a current to second coil 74, there are magnetic fluxes extending through in-coil centers of first coil 71 and third coil 77. Because the same are the direction of the magnetic fluxes extending through the in-coil centers of first coil 71 and third coil 77 and the direction of the magnetic fluxes extending through the in-coil center of first coil 71 and through the in-coil center of third coil 77 upon flowing currents to first coil 71 and third coil 77, there is an increase in the magnetic fluxes extending through the in-coil center of first coil 71 and through the in-coil center of third coil 77.

This causes a great magnetic field through the array type choke coil, thereby increasing the inductance value furthermore. Accordingly, in case this positive-coupled array type choke coil is used as a power supply circuit choke coil 63 shown in FIG. 6, ripple currents can be suppressed by a great inductance value of the positive-coupled array type choke coil, thus realizing a power supply circuit usable in high frequency band and capable of coping with a large current.

In the case of a structure shown in FIG. 10, when current flows to first coil 71, a magnetic flux takes place. The magnetic flux constitutes a magnetic circuit in a manner so as to extend through an in-coil center of first coil 71, to pass an outside of first coil 71 and return again to the in-coil center of first coil 71. When currents flow to second coil 74 and third coil 77, magnetic circuits are similarly constituted. At this time, because first coil 71, second coil 74 and third coil 77 are in a V-formed arrangement, there exists a superimposed magnetic flux among the magnetic fluxes of magnetic circuits caused by flow of currents to first coil 71, second coil 74 and third coil 77. Particularly, the magnetic superimpositions are intensified respectively around the centers of the coils.

Of the magnetic flux caused by flow of a current to first coil 71, there is a magnetic flux extending through an in-coil center of second coil 74. Likewise, of the magnetic flux caused by flowing a current to third coil 77, there is a magnetic flux extending through an in-coil center of second coil 74. Because opposite are the direction of the magnetic flux extending through the in-coil center of second coil 74 and the direction of the magnetic flux extending through the in-coil center of second coil 74 upon flowing a current to second coil 74, there is a decrease in the magnetic flux extending through the center of second coil 74.

Meanwhile, of the magnetic flux caused by flow of a current to second coil 74, there are magnetic fluxes extending through in-coil centers of first coil 71 and third coil 77. Because different are the direction of the magnetic fluxes extending through the in-coil centers of first coil 71 and third coil 77 and the direction of the magnetic fluxes extending through the in-coil center of first coil 71 and through the in-coil center of third coil 77 upon flowing currents to first coil 71 and third coil 77, there is a decrease in the magnetic fluxes extending through the in-coil center of first coil 71 and through the in-coil center of third coil 77.

This results in a decreased magnetic field caused on the array type choke coil, thereby enabling to decrease the inductance value. Accordingly, in case of that such a negative-coupled array type choke coil is used as power supply circuit choke coil 63 shown in FIG. 6, choke coil 63 can be enhanced in direct-current superimposition characteristic because of a decreased inductance value, thus realizing a power supply circuit capable of coping with a larger current.

The inductance value of the array type choke coil in the present embodiment is influenced by a coupling of first coil 71, second coil 74 and third coil 77. Namely, the coupling of first coil 71, second coil 74 and third coil 77 changes depending upon a superimposition degree of a magnetic-circuit magnetic flux caused by flow of currents to first coil 71, second coil 74 and third coil 77. The superimposition changes depending upon an arrangement of first coil 71, second coil 74 and third coil 77. Accordingly, by respectively changing the distances to the centers of first coil 71 and to third coil 77, that are coils on the both sides of second coil 74, with reference to second coil 74, the superimposition of magnetic flux can be varied. By a change of magnetic flux superimposition, the inductance value of the array type choke coil can be changed without changing the number of turns of first coil 71, second coil 74 and third coil 77.

Here, there is shown, in FIGS. 11 to 13B, a result of determining a relationship between a distance to, or height of, a center point of first coil 71 and a center point of second coil 74 and an inductance value of the array type choke coil in the present embodiment in positive or negative coupling.

Figure 11:
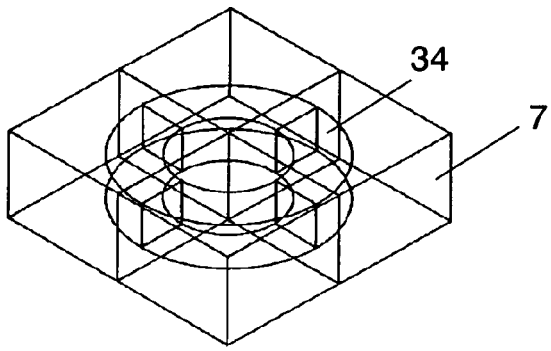
FIG. 11 is a figure showing a basic structure for determining a relationship between the distance between center points or height of the coils and an inductance, which is a perspective view of a coil part of terminal-integrated type coil and the surrounding magnetic material region.

FIG. 11 is a projection perspective view showing, by extraction, a region of the coil part 34 and the surrounding magnetic material 7 of the terminal-integrated type coil used in the present embodiment. The core as magnetic material 7 is a rectangular prism of 10 mm in the vertical by 10 mm in the horizontal by 3.5 mm in the height. Coil part 34 of the terminal-integrated type coil is given an inner diameter 4.2 mm, an outer diameter 7.9 mm, a height 1.7 mm and a magnetic permeability $\mu$=26. Note that, although the number of turns is set to be 1.5 turns in FIGS. 7 to 10, the above relationship was determined by setting the number of turns as 3 turns.

Figure 12A:
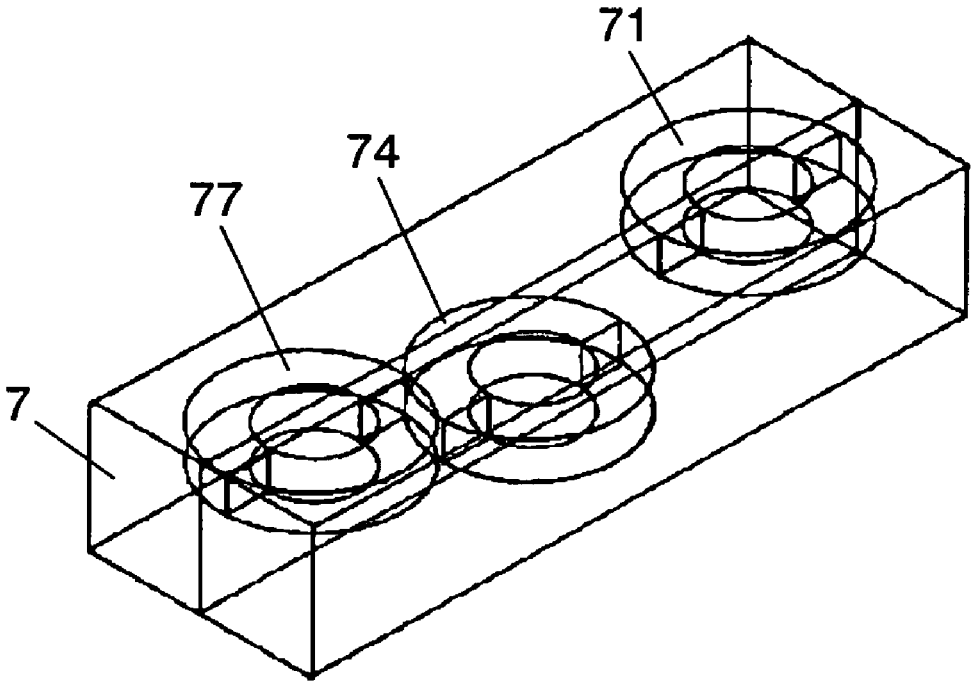
FIG. 12A is a projection perspective view showing an array type choke coil arrangement structure for determining respective relationship between the distances between center points or heights of the coils and inductances, in the array type choke coil according to the same embodiment.
Figure 12B:
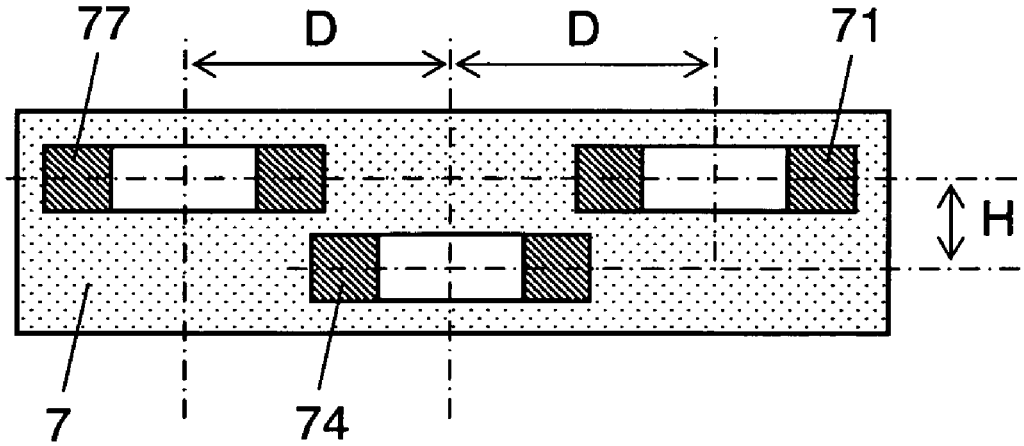
FIG. 12B is a sectional view showing an array type choke coil arrangement structure for determining respective relationship between distances between the center points or heights of the coils and inductances, in the array type choke coil according to the same embodiment.

FIGS. 12A and 12B are a projection perspective view (FIG. 12(A)) and sectional view (FIG. 12(B)) of an array type choke coil arrangement structure in the case of using the coil part 34 of the terminal-integrated type coil shown in FIG. 11. Those are views explaining the structures respectively for determining a relationship between distances D, which are distances from second coil 74 to first coil 71 and to third coil 77, respectively, and an inductance value, and a relationship between heights H of first coil 71 and of third coil 77 with reference to second coil 74 and an inductance value.

Figure 13A:
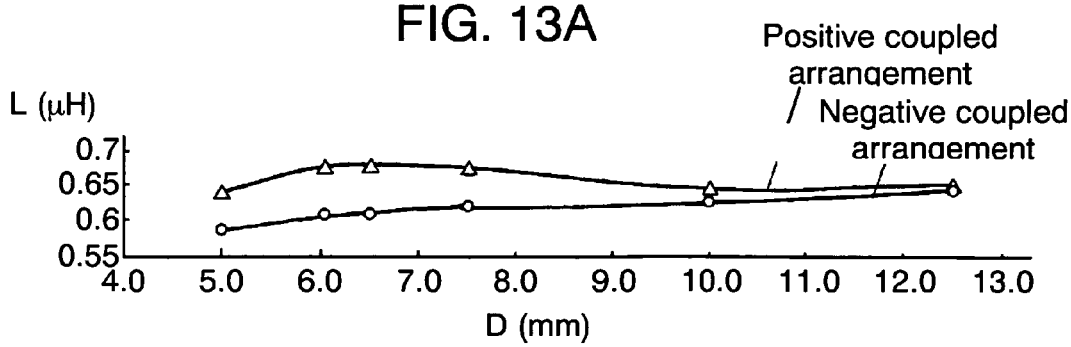
FIG. 13A is a figure showing a relationship between the distance between center points of the coils and an inductance, in the array type choke coil according to the same embodiment.

FIG. 13A is a result of determining inductance value L when distance D between the center point of first coil 71 and the center point of second coil 74 (this is equal to the distance D between the center point of third coil 77 and the center point of second coil 74) is varied with setting height H to be constant as H=2.7 mm. From a result of this, in the case of positive coupled arrangement of the coils, inductance value can be increased as compared to the case of negative coupled arrangement. It has been known that changing distance D can vary inductance value L.

Figure 13B:
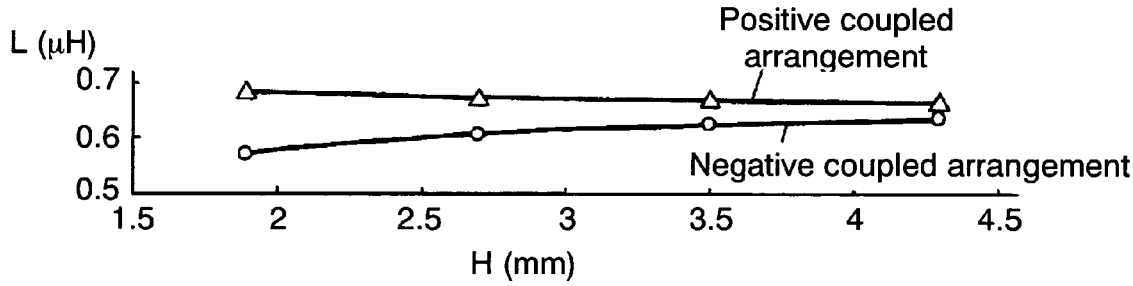
FIG. 13B is a figure showing a relationship between the height of center points of the coils and an inductance, in the array type choke coil according to the same embodiment.

FIG. 13B is a figure showing a relationship between distance D and inductance value L in the case of changing height H with setting the distance D to be constant. As can be understood from this figure, it has been found that changing height H can vary inductance value L. Note that, at this time, distance D was set to be constant at D=6.5 mm.

This can realizes an array type choke coil obtaining desired inductance value L by varying distance D and height H through changing the positions of the center point of first coil 71 and center point of third coil 77. Although the present embodiment set the distance between the center point of first coil 71 and the center point of second coil 74 equal to the distance between the center point of third coil 77 and the center point of second coil 74, the present invention is not limited to this. These distances may be different, respectively. Meanwhile, although the present embodiment set the heights of first coil 71 and third coil 77 equal, these may be not necessarily equal but be different.

From the result of these, in case an array type choke coil in an arrangement structure having a distance to a center point of first coil 71 and to center point of third coil 77 with reference to second coil 74 designed to increase the inductance value is used as choke circuit 63 of a power supply circuit shown in FIG. 6 similarly to the array type choke coil of embodiment 1, it is possible to realize a power supply circuit capable of suppressing ripple currents and capable of coping with a large current in a high-frequency band.

Meanwhile, in case an array type choke coil in an arrangement structure having a distance between a center point of first coil 71 and center point of third coil 77 designed to suppress the inductance value is used as choke coil 63 of the power supply circuit shown in FIG. 6 similarly to the array type choke coil of embodiment 1, it is possible to realize a power supply circuit capable of enhancing the direct-current superimposition characteristic of choke coil 63 and capable of coping with a larger current.

Incidentally, although the array type choke coil of the present embodiment had the terminal-integrated type coils three in the gang, those may be four or more in the gang thus being increased in line. The terminal-integrated type coils arranged in line may be arranged in two rows, three rows or more on a plane, or otherwise may be in a stack arrangement. The number of coil turns is not limited to 1.5 turns. Furthermore, there is no especial need to make equal the number and winding direction of the coils. Although the present embodiment arranged the coils in a V-form, they may be arranged in an inverted V-form.

Figure 14:
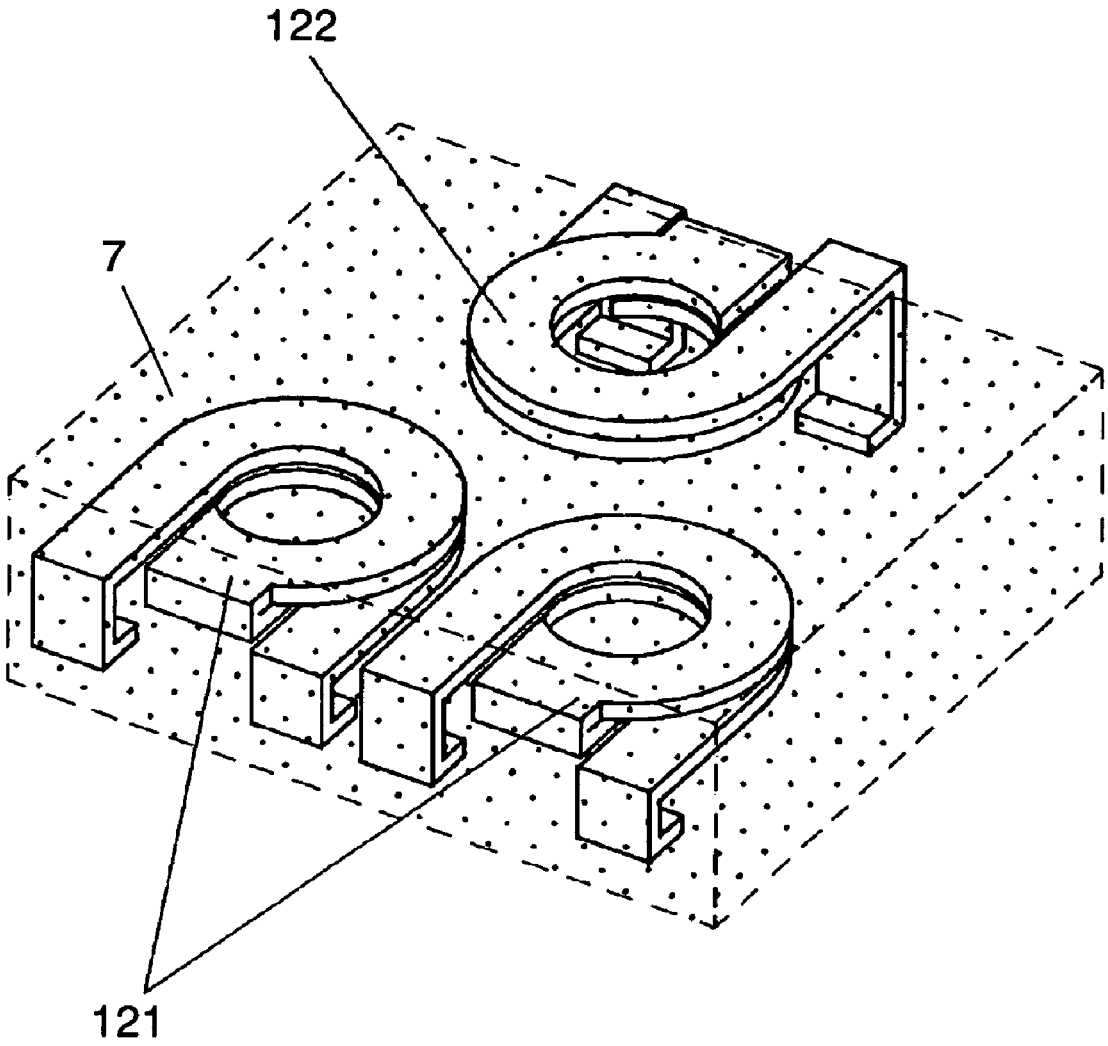
FIG. 14 is a figure showing a modification of the array type choke coil according to the same embodiment, which is a perspective view showing a structure arranging another terminal-integrated type coil in a position deviated from a plurality of terminal-integrated type coils arranged in line.

As shown in FIG. 14, it is possible to arrange terminal-integrated type coil 122 in a position deviated from a plurality of terminal-integrated type coils 121, 121 set up in line. This can enhance the charge ratio of the coils within magnetic material 7, enabling to further reduce the size of the array type choke coil overall.

As in the above, the array type choke coil of the present embodiment can realize an array type choke coil capable of being reduced in size, providing a high coupling and capable of coping with a large current. Hence, it exhibits great effect if used on an electronic apparatus such as a cellular telephone.

EMBODIMENT 3

Figure 15:
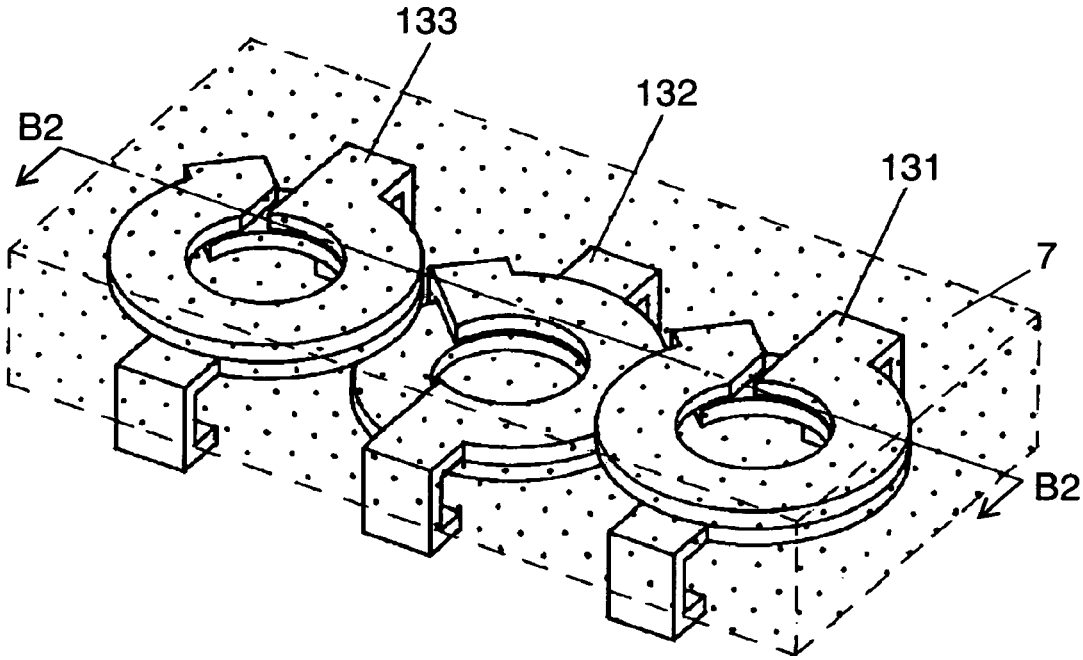
FIG. 15 is a projection perspective view of an array type choke coil according to embodiment 3 of the present invention.
Figure 16:
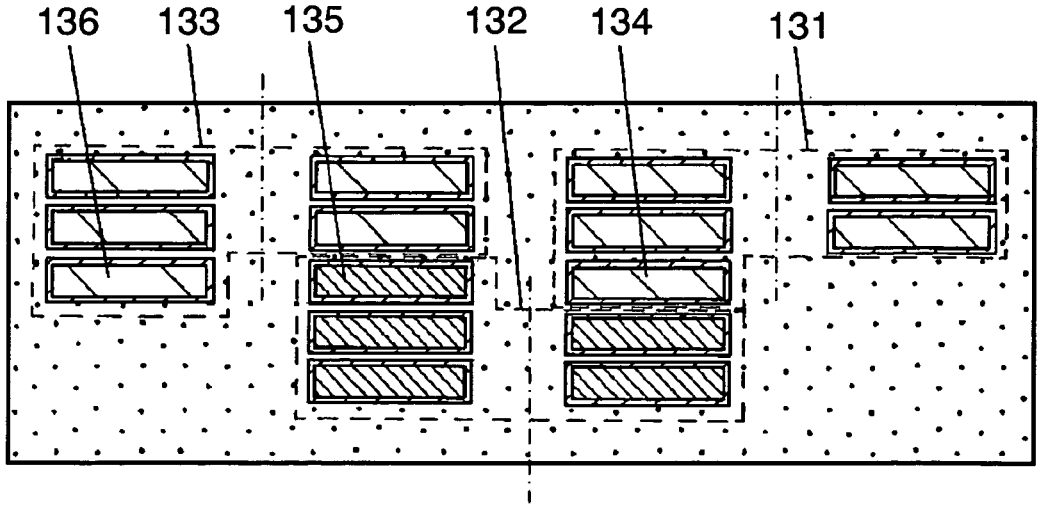
FIG. 16 is a sectional view along the line B2-B2 shown in FIG. 15 of the array type choke coil according to the same embodiment.

While referring to FIGS. 15 and 16, explanation is made on an array type choke coil in embodiment 3 of the present invention. The array type choke coil of the present embodiment is similar in basic structure to the array type choke coil in embodiment 1 of the present invention.

FIG. 15 is a projection perspective view of an array type choke coil in the present embodiment. First coil 131, second coil 132 and third coil 133 are terminal-integrated type coils formed by blanking and folding a metal sheet, similarly to the array type choke coil of the first embodiment. The respective coils have the number of turns of 2.5 turns.

FIG. 16 is a sectional view along the line B2-B2 in the array type choke coil shown in FIG. 15. There is provided an arrangement such that the center axis of first coil 131, the center axis of second coil 132 and the center axis of third coil 133 are in parallel and wherein first coil 131 and third coil 133 are positioned in the upper stand while second coil 132 is positioned in the lower stand. There is provided an arrangement such that end 134 of first coil, end 135 of second coil 135 and end 136 of third coil are on the same plane. The coil parts of first coil 131, second coil 132 and third coil 133 are buried within the magnetic material 7.

The array type choke coil in the above structure is explained of its operation in the below.

The array type choke coil of the present embodiment can be reduced in size, provide a high coupling and cope with a large current, which is similar to embodiment 1. The array type choke coil of the present embodiment provides a characterization in the number of turns of coil and arrangement of the coils, thereby making it possible to realize a further small-sized shorter structure.

As shown in FIG. 16, first coil 131 at its left part having a height of 3 turns is laid over the right part of second coil 131 having a height of 2 turns. Third coil 133 at its right part having a height of 2 turns is laid over the left part of second coil 132 having a height of 3 turns. Because first coil 131, second coil 132 and third coil 133 are respectively given 2.5 turns, such a coil arrangement is feasible. Accordingly, when first coil 131 and third coil 133 are structurally arranged upper while second coil lower, it is possible to easily realize a coil stack structure increased in charge degree without making a useless space. This can realize an array type choke coil further smaller in size and shorter in structure.

In case such an array type choke coil is used as a choke coil 63 of a power supply circuit shown in FIG. 6, size reduction is possible while easily securing an inductance value required in design, thus realizing a power supply circuit apparatus small in size and high in performance.

EMBODIMENT 4

Figure 17A:
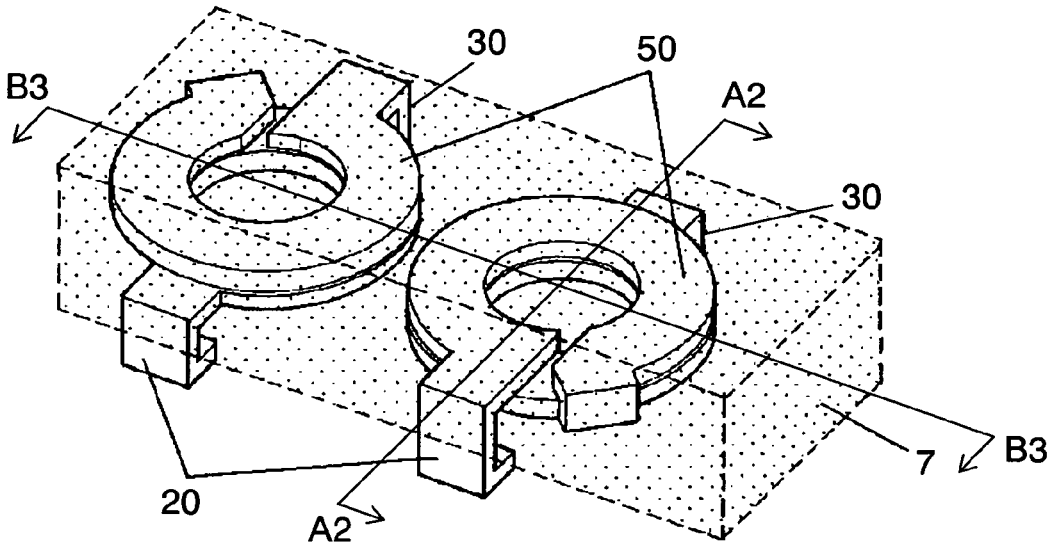
FIG. 17A is a projection perspective view in the case of a positive coupled structure, in an array type choke coil according to embodiment 4 of the present invention.
Figure 17B:
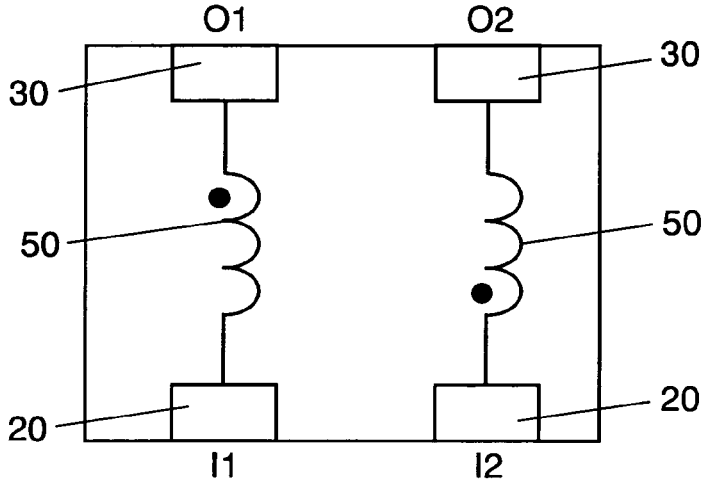
FIG. 17B is a wiring diagram of an array type choke coil in a positive coupled structure according to the same embodiment.
Figure 18:
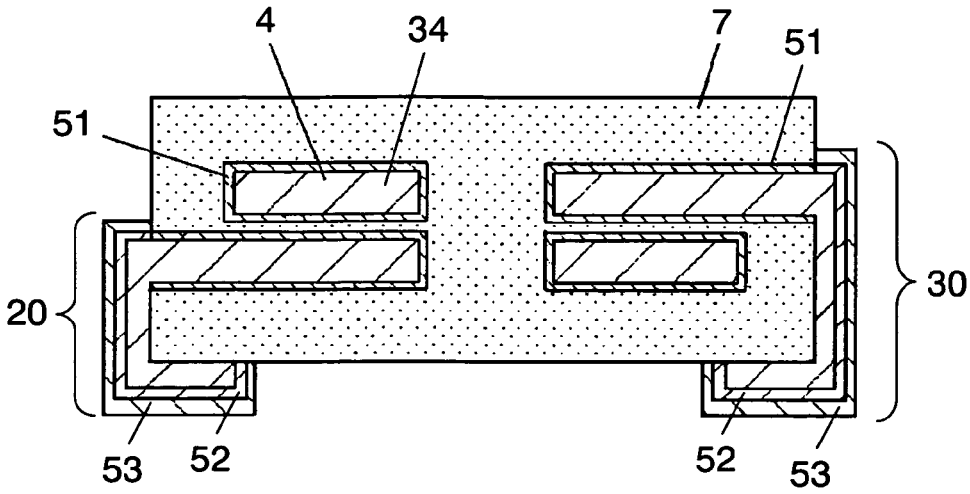
FIG. 18 is a sectional view along the line A2-A2 shown in FIG. 17A of the array type choke coil according to the same embodiment.

An array type choke coil structure in embodiment 4 of the present invention is explained with using FIGS. 17A, 17B and 18. FIG. 17A is a projection perspective view of the array type choke coil of the present embodiment, and FIG. 17B is a wiring diagram thereof. FIG. 18 is a sectional view along the line A2-A2 of the array type choke coil shown in FIG. 17A.

At first, because the terminal-integrated type coil 50 may be fabricated similarly to the fabrication method shown in FIGS. 3 and 4 of embodiment 1, explanation is omitted. The number of turns of terminal-integrated type coil 50 does not always have to be an integer but can be set freely, e.g., 1.5 turns or 1.75 turns. This is true for coil size, inductance value and the like. The present embodiment explains those coils merely as terminal-integrated type coil 50 in the below.

Accordingly, the terminals connected to them are explained merely as input terminal 20 and output terminal 30. Magnetic material 7, because the same one as the material explained in embodiment 1 can be fabricated in the same manufacturing method, is omitted of explanation.

The array type choke coil of the present embodiment is structured by arranging a plurality of terminal-integrated type coils 50 within magnetic material 7. For an array type choke coil, terminal-integrated type coils 50 are first respectively arranged in predetermined positional relationship, and press-formed by covering the part excepting ends with magnetic material 7. The condition of press-forming is satisfactorily done similarly to embodiment 1, and hence omitted of explanation.

The ends extended from magnetic material 7 are exposed at and bent on the outer layer, and the exposed region is formed with underlying layer 52 of nickel (Ni) or an alloy containing nickel (Ni) in order to prevent the terminals of copper or silver from oxidizing and to improve connection reliability of solder or the like. Furthermore, an uppermost layer 53 of solder, thin (Sn) or lead (Pb) is formed on the underlying layer 52 of Ni or an alloy containing Ni.

All the exposed ends are bent along the bottom and the surface adjacent to the bottom of the array type choke coil, and formed into input terminal 20 and output terminal 30. This provides substantially a leadless structure, enabling high density mounting as compared to the conventional array type choke coil with leads. The above manufacturing method is basically the same as embodiment 1.

Incidentally, magnetic material 7 is preferably in a rectangular prism form, which is similar to the case of embodiment 1. This facilitates sucking for automated bonding, alignment onto a printed board, and the like. Mounting direction and terminal polarity may be shown, and chamfer may be performed. Furthermore, there is no especial restriction on the form of the magnetic material provided that the top surface thereof is in a planer form and polygonal or circular cylindrical form will do.

Explanation is made below on the arrangement structure of a plurality of coils to be buried within magnetic material 7. The present embodiment arranges two coils same in coil size and the number of turns on a same plane as shown in FIG. 17A such that the magnetic fluxes to be generated at respective coil centers are to be caused in opposite directions. FIG. 17B is a wiring diagram thereof, wherein power-supply connection points I1, I2, O1, O2 are shown at input terminals 20 and output terminals 30 of the respective terminal-integrated type coils 50, 50.

Figure 19A:
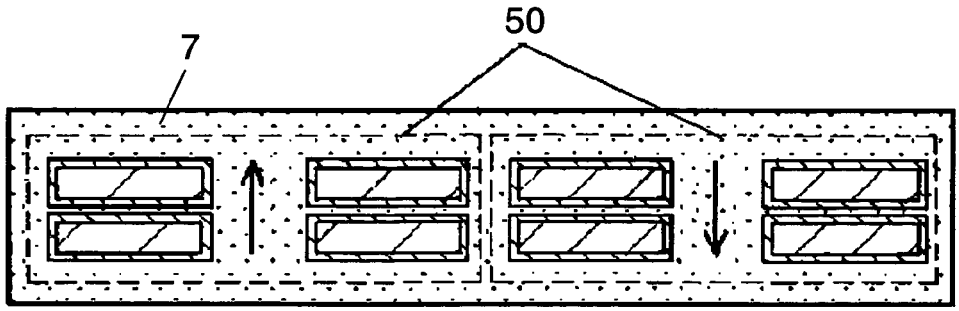
FIG. 19A is a sectional view along the line B3-B3 shown in FIG. 17A of the array type choke coil according to the same embodiment.
Figure 19B:
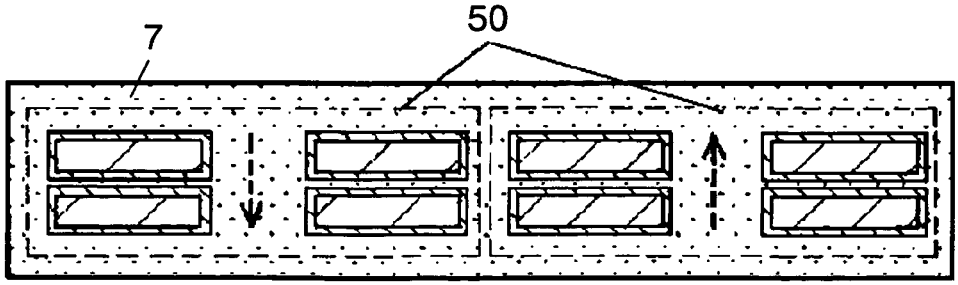
FIG. 19B is a sectional view along the line B3-B3 shown in FIG. 17A of the array type choke coil according to the same embodiment.

Explanation is made concerning what form a magnetic field to occur becomes in the case of providing the above structure. FIGS. 19A and 19B are sectional views along the line B3-B3 shown in FIG. 17A wherein, when a current flows, the magnetic fluxes extending through the respective coils become alternate in direction. Accordingly, magnetic circuits are formed to superimpose together the magnetic fluxes extending through respective coils. As a result, there is an increase in the inductance values of the respective coils. The arrangement of direction of coils for causing such a magnetic flux coupling is a positive coupling structure.

Figure 20A:
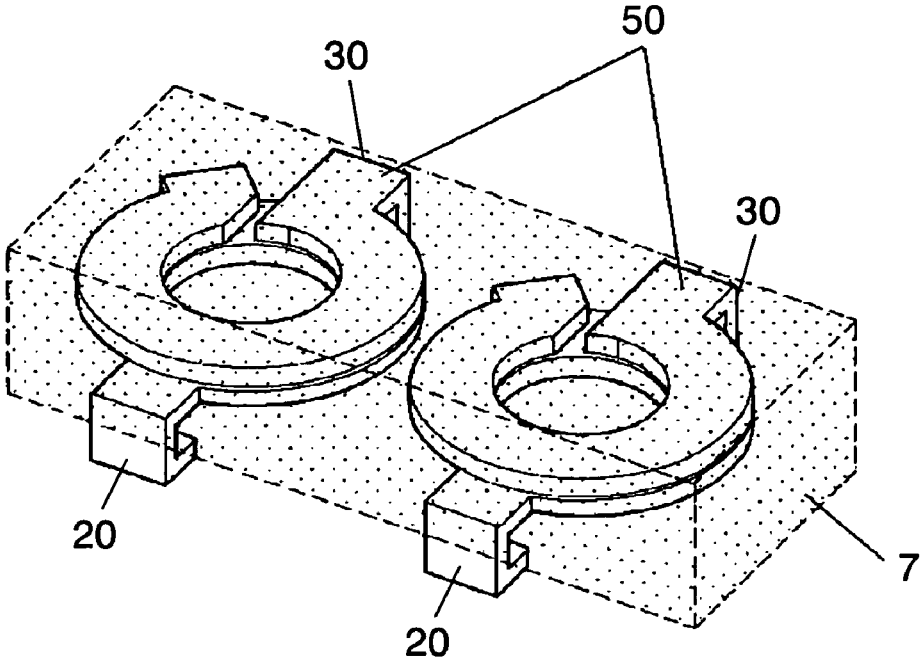
FIG. 20A is a projection perspective view in the case of a negative coupled structure, in the array type choke coil according to the same embodiment.
Figure 20B:
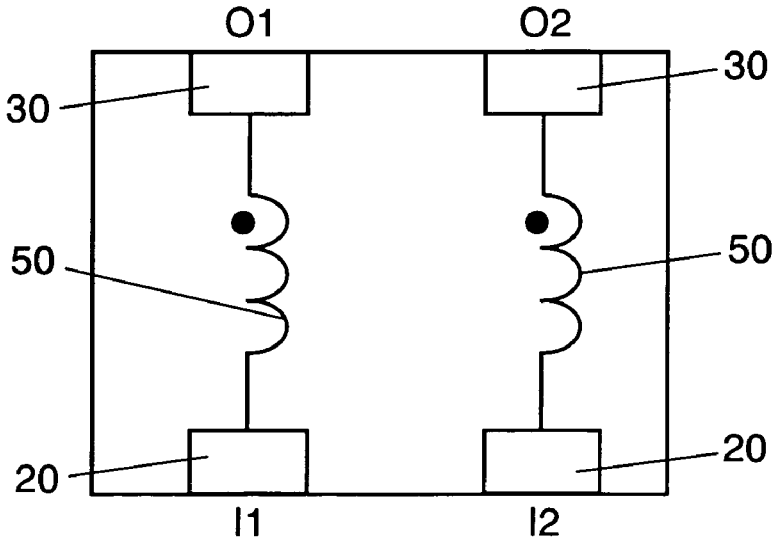
FIG. 20B is a wiring diagram of the array type choke coil in a negative coupled structure according to the same embodiment.

Meanwhile, there is an array type choke coil structure in that two coils same in coil size and the number of turns are arranged on the same plane similarly to FIG. 17A but arranged such that the respective ones cause magnetic fluxes extending through the coils in the same direction when current flows. FIG. 20A is a projection perspective view of array type choke coil arranging terminal-integrated type coils 50 that are the same in the winding direction on the same plane. FIG. 20B shows a wiring diagram of the same. Power-supply connection points I1, I2, O1, O2 are respectively shown at input terminals 20 and output terminals 30 of respective terminal-integrated type coils 50, 50.

Figure 21A:
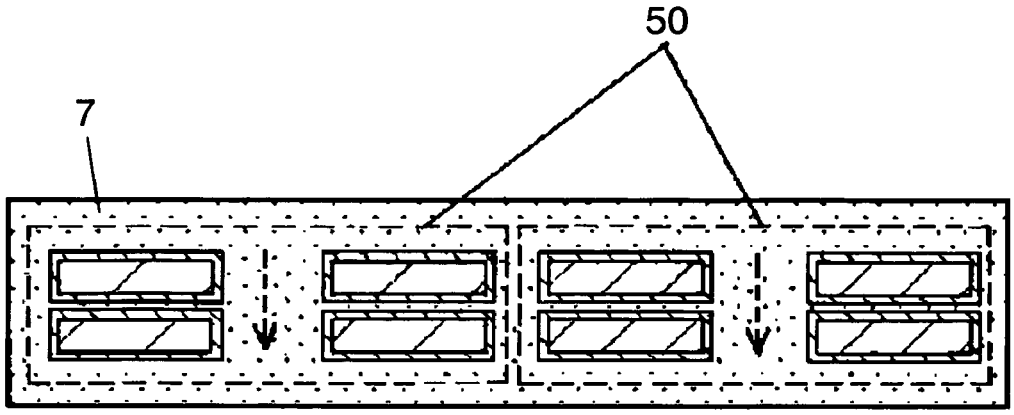
FIG. 21A is a sectional view of the array type choke coil according to the same embodiment, the structure of which is such that the magnetic fluxes extending through two coils are the same in direction.
Figure 21B:
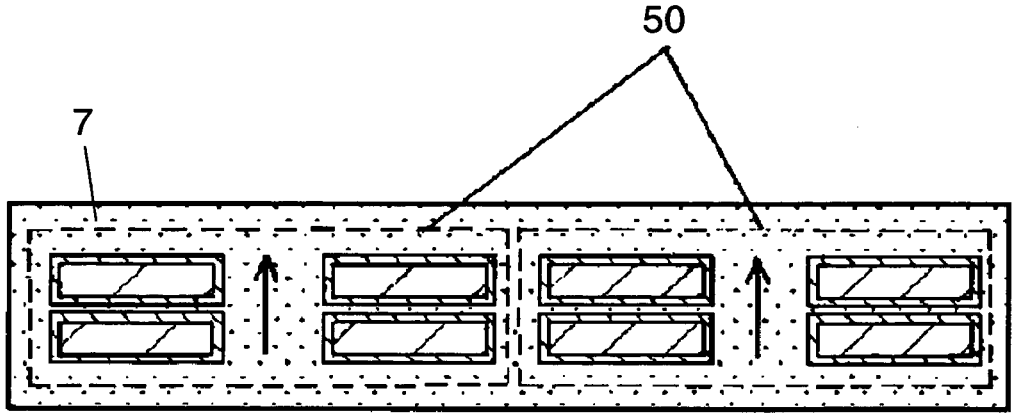
FIG. 21B is a sectional view of the array type choke coil according to the same embodiment, the structure of which is such that the magnetic fluxes extending through two coils are the same in direction.

FIGS. 21A and 21B are sectional views of the array type choke coil wherein, when current flows, the magnetic fluxes extending through the respective coils are all in the same direction. Accordingly, although the magnetic fluxes extending through the respective coils pass an outside of the coil to return to the former position, the magnetic flux coupling in this case is weak. Magnetic circuits are respectively formed in a direction that the magnetic fluxes caused wholly on the array type choke coil are to cancel each other. Namely, obtained is an effect to suppress magnetic flux saturation. Namely, the arrangement structure of coils is negative coupling.

As described in the above, different characteristics are available in the arrangements of positive coupling and negative coupling. Explanation is made on the result obtained by determining a relationship between distance R between the center points of two coils in positive coupling and inductance value L, and a relationship between distance R between the center points of two coils in negative coupling arrangement and inductance value L.

Figure 22A:
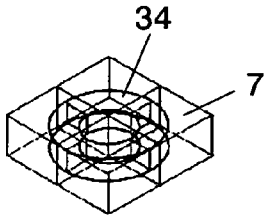
FIG. 22A is a figure showing a basic structure for determining a relationship between the distance between center points of the coils and an inductance in the array type choke coil according to the same embodiment, which is a perspective view of a coil part of terminal-integrated type coil and the surrounding magnetic material region.

FIG. 22A is a projection perspective view showing one coil part 34 and a part of magnetic material 7 surrounding the same. Coil part 34 is in a size having an inner diameter of 4.2 mm, an outer diameter of 7.9 mm and a height of 1.7 mm, the number of turns of which is set to be 3 turns. The core formed by the magnetic material 7 is provided with a magnetic permeability $\mu$=26 and a size of 10 mm×10 mm×3.5 mm. Inductance value L obtainable from these is L=0.595 μH.

Figure 22B:
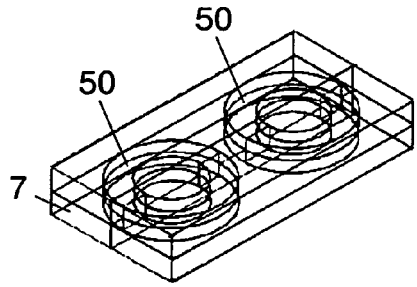
FIG. 22B is a projection perspective view showing an array type choke coil arrangement structure for determining a relationship between the distance between center points the coils and inductances, in the array type choke coil according to the same embodiment.
Figure 22C:
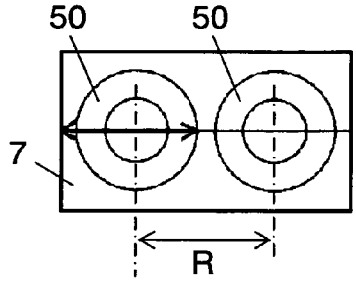
FIG. 22C is a plan view showing an array type choke coil arrangement structure for determining a relationship between the distance between center points the coils and inductances, in the array type choke coil according to the same embodiment.
Figure 22D:
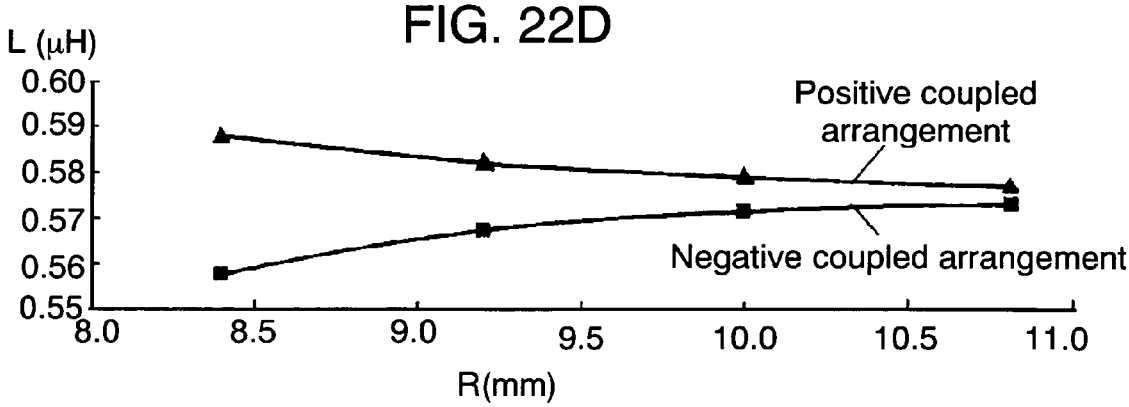
FIG. 22D is a view showing a relationship between the distance between center points the coils and an inductance, in the array type choke coil according to the same embodiment.

FIGS. 22B and 22C are a projection perspective view and plan view showing a structure that coil part 34 and magnetic material 7 in a unit structure shown in FIG. 22A is arranged two on a same plane. There is shown in FIG. 22D a result obtained by comparing distance R between center points and inductance value L by using, as a parameter, a difference between positive coupled structure and negative coupled structure.

When distance R between center points of two coils 50, 50 is assumed 10 mm, inductance value L in a positive coupled structure was 0.579 μH while inductance value L in a negative coupled structure was 0.571 μH that is −1.4% smaller than inductance value L in the positive coupled structure. Likewise, when distance R between center points was set to be 9.2 mm, inductance value L in a positive coupled structure was 0.583 μH while inductance value L in a negative coupled structure was 0.567 μH that is −2.7% smaller than the same.

Namely, in a positive coupled structure, as distance R between center points is decreased, inductance value L increases. Meanwhile, in a negative coupled structure, as distance R between center points is decreased, inductance value L also decreases. Namely, in a positive coupled structure, in case distance R between center points is decreased, inductance value L can be increased. Without increasing the number of turns of the coils, a great inductance value can be obtained. Furthermore, the smaller distance R between center points is, the greater inductance value L can be taken, which is preferred in achieving size reduction of the array type choke coil.

Meanwhile, in a negative coupled structure, the smaller distance R between center points is, inductance value L also decreases. In a negative coupled structure, because there is a mutual cancellation of the direct-current magnetic field components caused on the respective coils, the magnetic field is readily prevented from saturating even if flowing a large current. Namely, in a negative coupled structure, by providing a choke coil incorporating a plurality of coils, size reduction is possible rather than the case of using a plurality of choke coils comprising one coil in combination. Besides, direct-current superimposition characteristic can be greatly improved.

Next explained is an array type choke coil arranging three terminal-integrated type coils within magnetic material 7 (hereinafter, referred to as a three-array type choke coil).

Figure 23A:
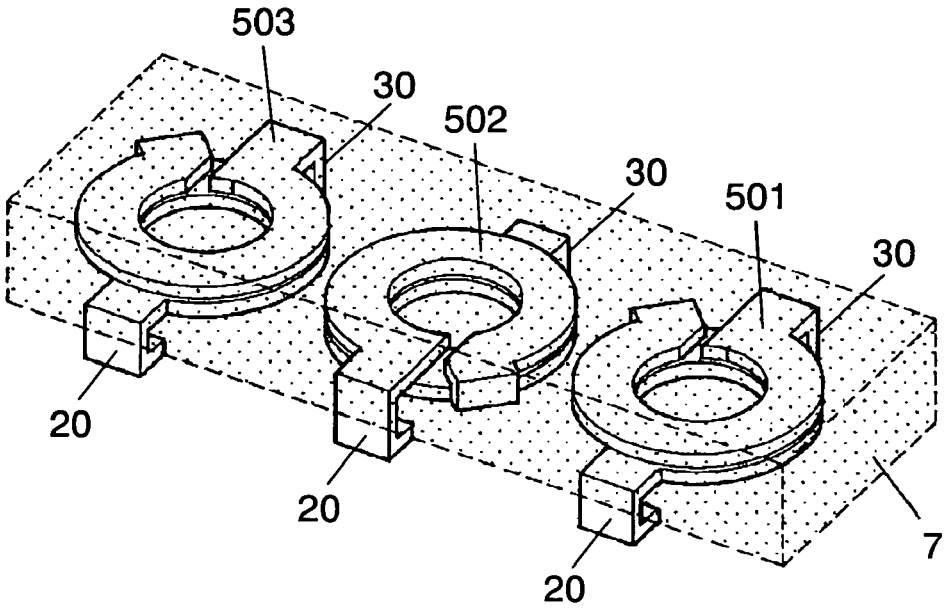
FIG. 23A is a modification of the array type choke coil according to the same embodiment, which is a projection perspective view showing the case in which a three-array type choke coil is in a positive coupled structure.
Figure 23B:
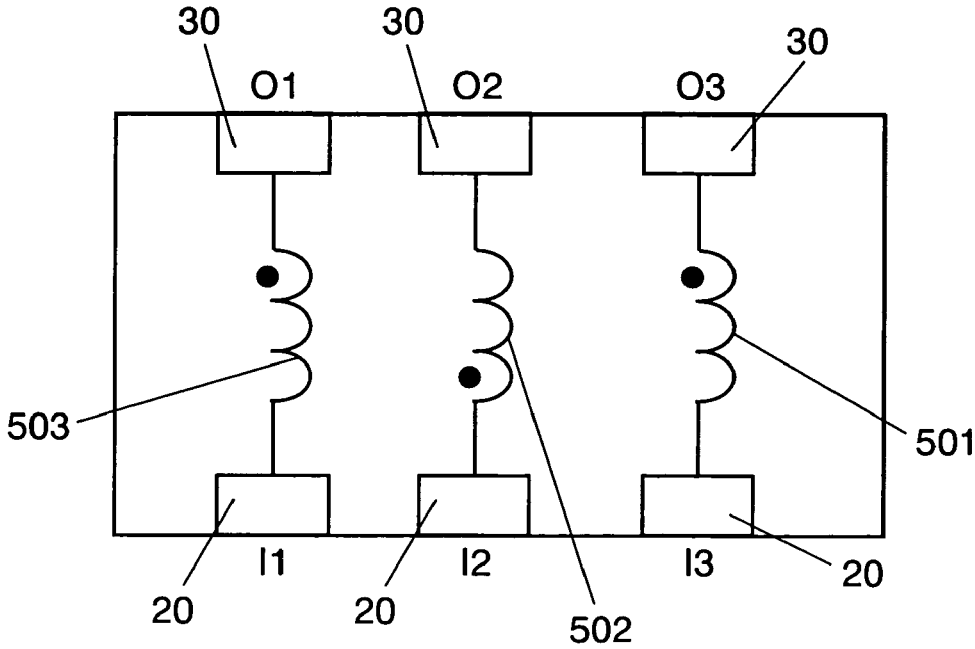
FIG. 23B is a wiring diagram of the three-array type choke coil in a positive coupled structure of the same modification.
Figure 23C:
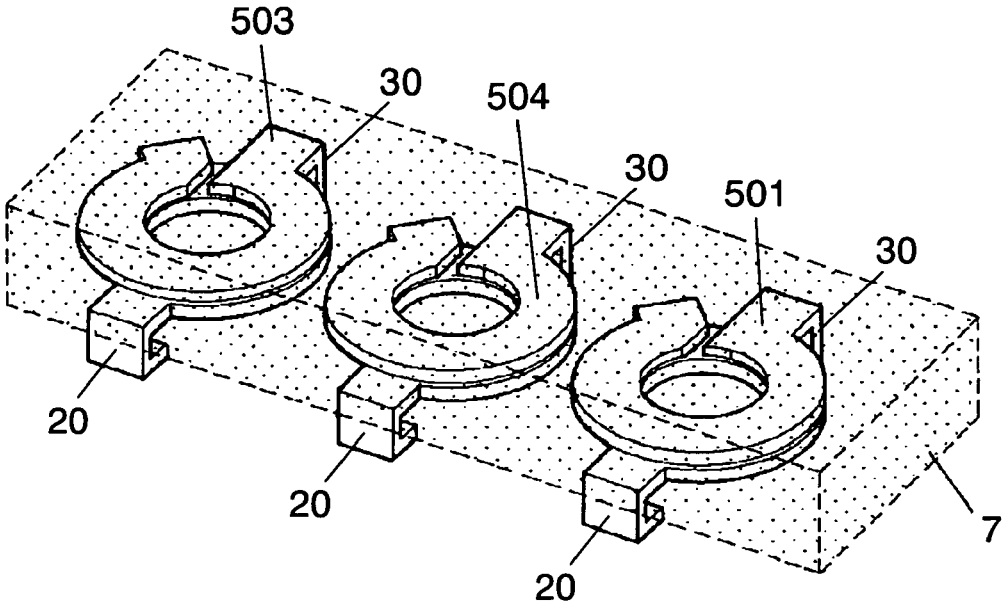
FIG. 23C is an another modification of the array type choke coil according to the same embodiment, which is a projection perspective view showing the case in which a three-array type choke coil is in a negative coupled structure.
Figure 23D:
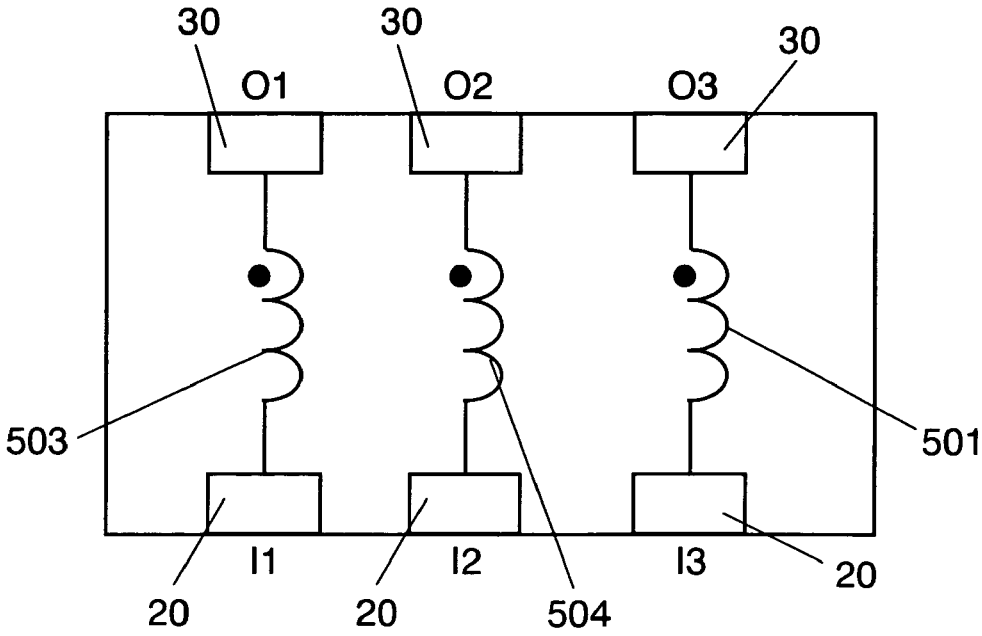
FIG. 23D is a wiring diagram of a three-array type choke coil in a negative coupled structure of the same modification.

FIG. 23A is a projection perspective view showing a structure of arranging three terminal-integrated type coils 501, 502, 503 in line. Note that these terminal-integrated type coils, hereinafter, are distinguishingly referred to as right coil 501, center coil 502 and left coil 503, respectively. FIG. 23B shows a wiring diagram of a three-array type choke coil in an arrangement that the respective ones are in positive coupled structures. FIG. 23C is a projection perspective view of a three-array type choke coil in a structure in that three terminal-integrated type coils 501, 502, 503 are similarly arranged in line to be negative coupled structures. Likewise, these terminal-integrated type coils 501, 503, 504, hereinafter, are distinguishingly referred to as right coil 501, center coil 504 and left coil 503, respectively. In this structure, right coil 501 and left coil 503, are both in the same winding direction, including center coil 504. FIG. 23D shows a wiring diagram of the array type choke coil. Note that, in FIGS. 23B and 23D, the power-supply connections at input terminal 20 and output terminal 30 are respectively denoted as I1, I2, I3, O1, O2 and O3.

Table 1 shows a result of inductance value L of each coil depending upon a difference between positive coupled structure and negative coupled structure of the coils in the present embodiment.

TABLE 1

| Coupling Structure | | Coil Arrangement and Magnetic Flux Direction | Inductance Value (μH) |
|---|---|---|---|
| Coupling Structure | Positive Coupled Structure | FIG. 23A, FIG. 23B | Right Coil 501: 0.5798<br>Center Coil 502: 0.5870<br>Left Coil 503: 0.5798 |
| | Negative Coupled Structure | FIG. 23C, FIG. 23D | Right Coil 501: 0.5715<br>Center Coil 504: 0.5704<br>Left Coil 503: 0.5715 |

As understood from Table 1, the mean inductance value over the three coils is greater in a positive coupled structure than in a negative coupled structure arrangement. When attention is paid to center coil 502 only, it is 0.5704 μH in a negative coupled structure which is smaller by −2.8% than 0.5870 μH in the case of a positive coupled structure.

As described in the above, also in the three-array type choke coil using three terminal-integrated type coils 501, 502, 503, inductance value L can be arbitrarily adjusted by a positive coupled structure, a negative coupled structure or distance R between coil center points, similarly to the case using two terminal-integrated type coils 50. Thus, optimal design can be easily done because inductance value L can be set according to the use purpose of an array type choke coil.

Although the present embodiment explained two-array type and three-array type structures, the present invention is not limited thereto. The terminal-integrated type coils are ganged four or more into an in-line arrangement. Alternatively, arrangement may be on two rows or more by arranging a plurality of in-lined terminal-integrated type coils.

Figure 24A:
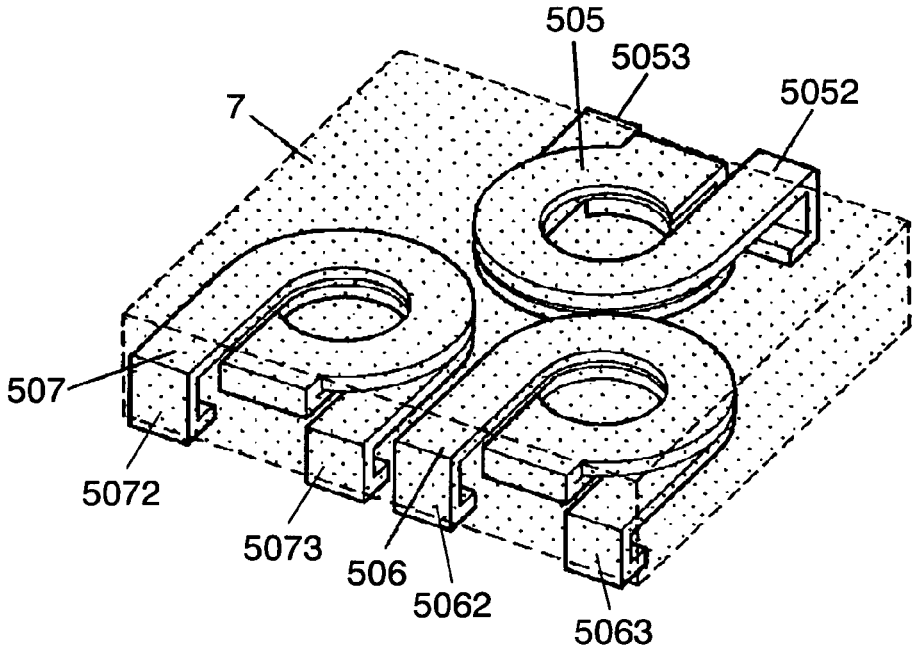
FIG. 24A is still another modification of the array type choke coil according to the same embodiment, in a projection perspective view of an array type choke coil arranging terminal-integrated type coils in a V-form on the same plane into a negative coupled structure.
Figure 24B:
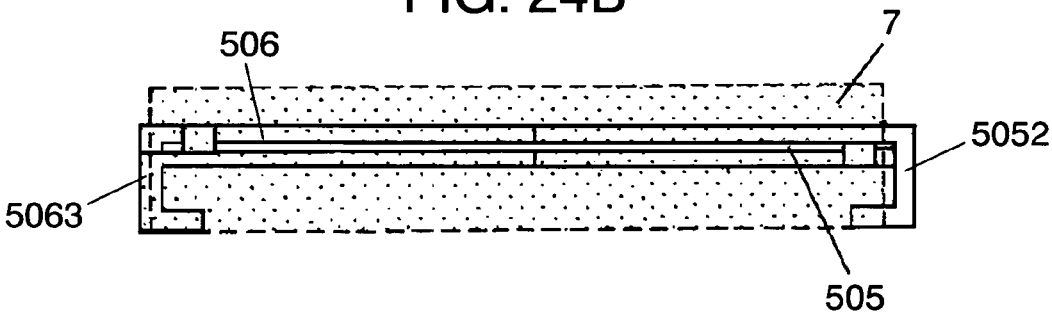
FIG. 24B is a side view of the array type choke coil of this other modification.
Figure 24C:
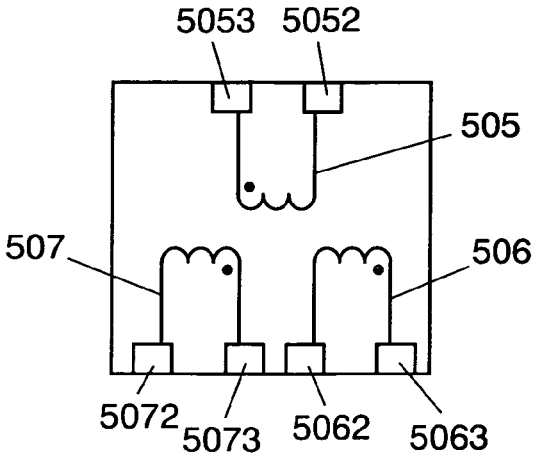
FIG. 24C is a wiring diagram of the array type choke coil of this other modification.

Moreover, at least one terminal-integrated type coil may be arranged in a position departing from a plurality of terminal-integrated type coils arranged in line. FIG. 24A is a projection perspective view of an array type choke coil in which three terminal-integrated type coils 505, 506, 507 having the same number of turns are arranged in a V-form on the same plane to be a negative coupled structure. FIG. 24B is a side view of the same while FIG. 24C is a wiring diagram. Terminal-integrated type coils 505, 506, 507 are structured such that input terminals 5052, 5062, 5072 and output terminals 5053, 5063, 5073 are exposed at the same direction, respectively. Such coils can be fabricated by etching or blanking a metal sheet, similarly to embodiment 1. In this manner, by alternately arranging a plurality of coils, it is possible to increase the charge ratio of the terminal-integrated type coils within magnetic material 7 and reduce the size of the entire.

Figure 25:
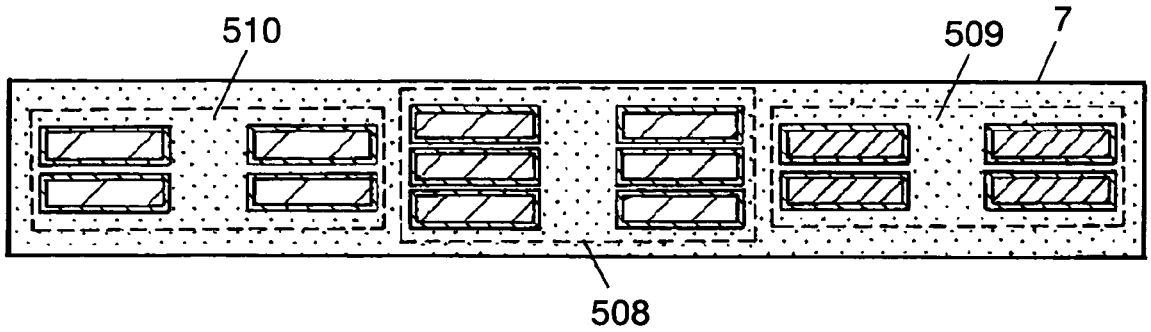
FIG. 25 is yet another modification of the array type choke coil according to the same embodiment, in a sectional view of an array type choke coil arranging the center points of terminal-integrated type coils on a line.

Meanwhile, in an array type choke coil structured as shown in FIG. 23A, it is possible to combine coils different in the number of turns. For example, FIG. 25 is a sectional view of an array type choke coil in which center points of terminal-integrated type coils are arranged in line. In this structure, terminal-integrated type coils 509, 510 having the number of turns of 2 turns and terminal-integrated type coil 508 having the number of turns of 3 turns are arranged so that at the center points of respective coils 508, 509, 510 are in line.

According to the present embodiment, regardless of the number of turns or size, by making a plurality of coils into a positive coupled structure or negative coupled structure or by adjusting the distances between center points of the respective coils to thereby bury them in magnetic material 7, inductance value can be accurately controlled coping with design and, besides, a small-sized short structured array type choke coil can be realized.

In case an array type choke coil thus structured as a choke coil of a power supply circuit explained in FIG. 6 in embodiment 1, a large inductance value can be obtained on an array type choke coil incorporating a plurality of terminal-integrated type coils in a positive coupled structure arrangement, for example. Accordingly, in case this is used as choke coil 63, a power supply circuit is possible which can suppress ripple currents.

Meanwhile, in an array type choke coil incorporating a plurality of terminal-integrated type coils in a negative coupled structure arrangement for example, it is easy to decrease the inductance value. Hence, a power supply circuit can be realized which corresponds to the greater current. Such a power supply circuit is preferably used as a power supply circuit of a personal computer, a cellular telephone or the like.

EMBODIMENT 5

Figure 26:
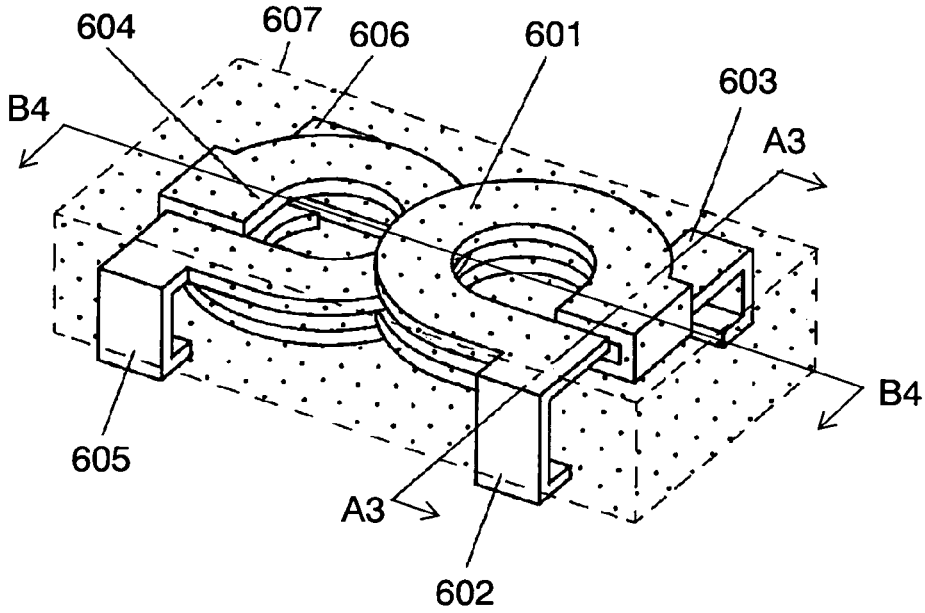
FIG. 26 is a projection perspective view of the array type choke coil according to embodiment 5 of the present invention.

FIG. 26 is a projection perspective view of an array type choke coil according to embodiment 5 of the present invention. In the present embodiment, terminal-integrated type coils are used two in the number and buried within magnetic material 607. First coil 601 is formed integral with first input terminal 602 and first output terminal 603. Second coil 604 is similarly formed integral with second input terminal 605 and second output terminal 606. Although the respective coils are different in winding direction, the number of turns is 2.0 turns in the both. Due to this, in the case of flowing currents to first coil 601 and second coil 604 through the respective first input terminal 602 and second input terminal 605, first coil 601 and second coil 604 have respective in-coil magnetic fluxes different in directions.

Meanwhile, arrangement is such that the center axis of first coil 601 and the center axis of second coil 604 are parallel and wherein two turns of first coil 601 are in mesh with one turn of second coil 604. First coil 601 and second coil 604 are buried within magnetic material 607. Magnetic material 607 is formed in a rectangular prism form. By such an arrangement, first coil 601 and second coil 604 are allowed for being magnetically coupled.

In this manner, because the array type choke coil of the present embodiment is a rectangular prism form, it is easy to handle the array type choke coil during automated mounting.

Figure 27:
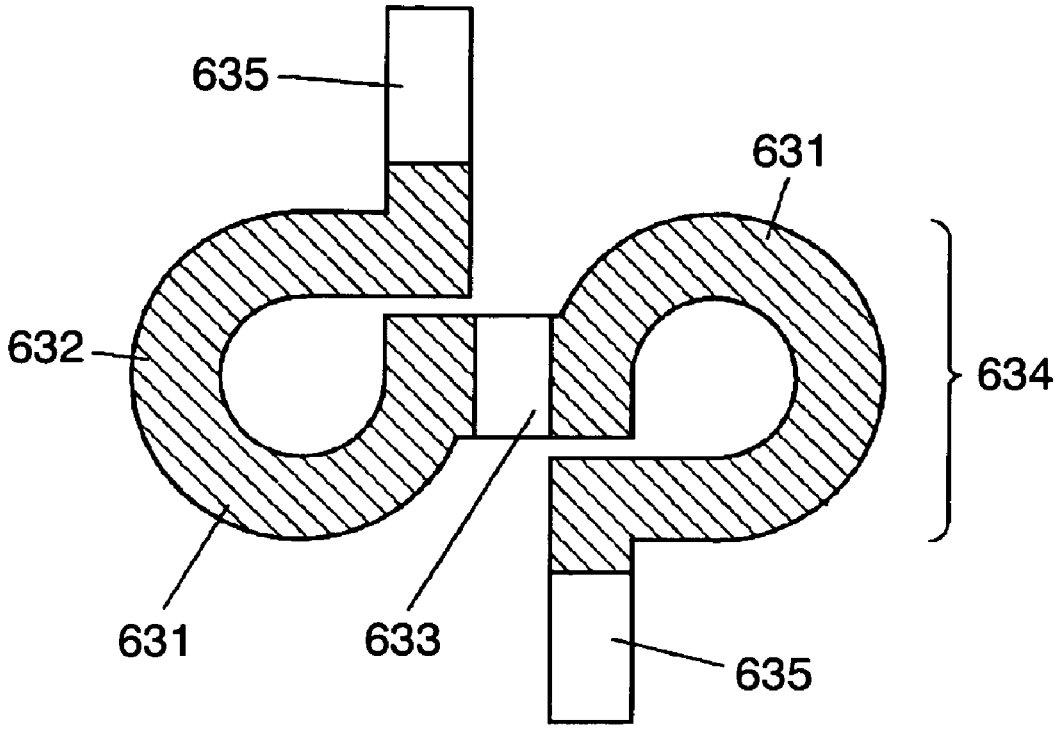
FIG. 27 is the array type choke coil according to the same embodiment, in a plan view showing a form of a blanked plate for fabricating a terminal-integrated type coil.
Figure 28:
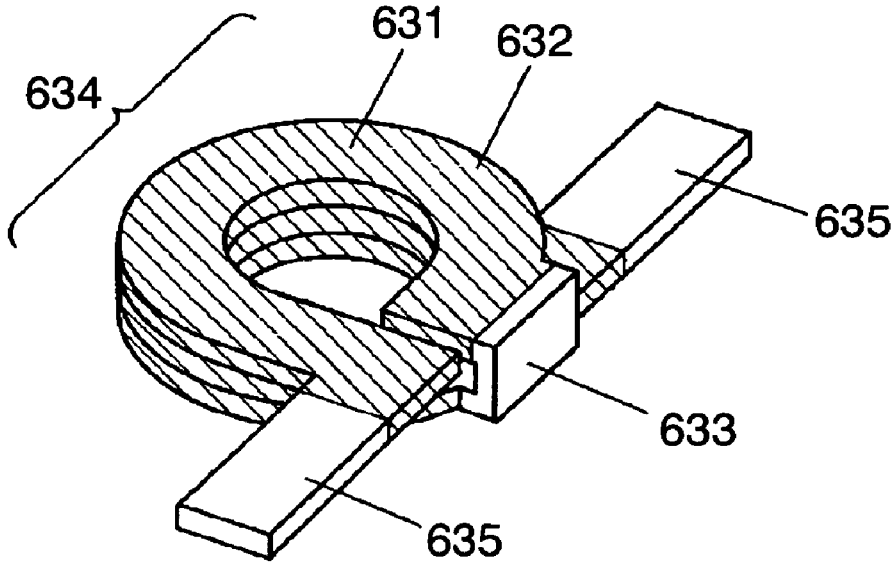
FIG. 28 is the array type choke coil according to the same embodiment, in a perspective view showing a form bent into a terminal-integrated type coil.

Here, explanation is made on a manufacturing method and concrete structure of a terminal-integrated type coil to be made into first coil 601 and second coil 604, by using FIGS. 27 and 28.

At first, as shown in FIG. 27, fabricated is a blanked sheet having two arcuate parts 631 formed by etching or blanking a metal sheet, connection 633 joining two arcuate parts 631 together and respective ends 635 extended from one ends of two arcuate parts 631. The metal sheet is not especially limited provided that it is of a material low in resistance and high in heat conductivity, e.g., copper or silver.

Insulation film 632 is formed on a surface of two arcuate parts 631. This prevents a short circuit between arcuate parts 631 to be made into a coil, in coil part 634 structured by folding and vertically superimposing two arcuate parts 631 of the blanked plate. Incidentally, no insulation film 632 is formed on a surface of connection 633. In this manner, because insulation film 632 is provided in the region excepting connection 633, there is no occurrence of breakage, stripping or the like in insulation film 632 even if connection 633 is bent. It is possible to suppress the coil characteristic deterioration resulting from insulation film 632.

The blanked sheet is bent at connection 633 of two arcuate parts 631 in a manner so as to overlap center points with each other, as shown in FIG. 28. Thus, two arcuate parts 631 are made into coil part 634. Two ends 635 are provided radial about a center of coil part 634, to form a terminal-integrated type coil. In the present embodiment, because first coil 601 and second coil 604 are structured to place two turns of first coil 601 in mesh with one turn of second coil 604, respective coil parts 634 are stacked with a gap in an amount of a thickness of arcuate part 631.

By using such a blanked sheet, coil part 634 where arcuate parts 631 are stacked is insulation-treated with insulation film 632. Stacking is possible without providing a gap between arcuate parts 631, enabling to realize an array type choke coil high in occupation area ratio.

Although FIGS. 27 and 28 show the case of 2 turns as a terminal-integrated type coil, easy fabrication is apparently possible with 3 turns or more by further increasing the number of arcuate parts 631 in a blanked sheet state.

Incidentally, explanation is omitted concerning magnetic material 607 because it can be fabricated of the material and by the method explained in embodiment 1.

As for a manufacturing method of an array type choke coil shown in FIG. 26, explanation is omitted similarly because fabrication is possible by the same manufacturing method as embodiment 1.

Figure 29:
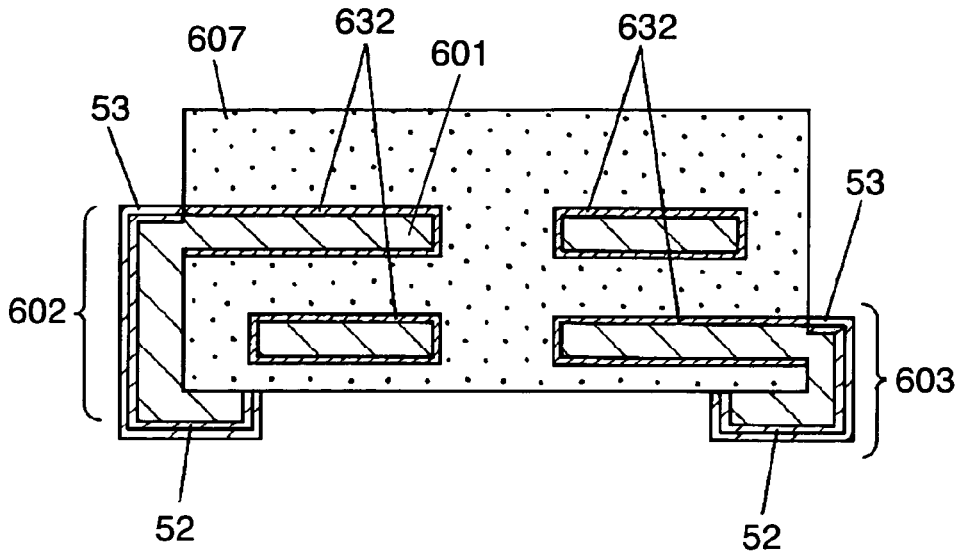
FIG. 29 is a sectional view along the line A3-A3 shown in FIG. 26 of the array type choke coil according to the same embodiment.

FIG. 29 shows a sectional view along the line A3-A3 in an array type choke coil shown in FIG. 26. First input terminal 602 and first output terminal 603 of first coil 601 is formed extending along the line from the side to the bottom of magnetic material 607. Meanwhile, underlying layer 52 is formed in the part where first input terminal 602 and first output terminal 603 are exposed at the surface of magnetic material 607. Uppermost layer 53 is formed in a manner so as to cover underlying layer 52. Underlying layer 52 is preferably a nickel (Ni) layer formed by plating while uppermost layer 53 is preferably a solder layer or thin (Sn) layer. Those are similar to embodiment 1.

Due to this, because first input terminal 602, second input terminal 605, first output terminal 603 and second output terminal 606 are formed, for example, with solder layers as uppermost layer 53, in the respective regions bent over the bottom of magnetic material 607, the array type choke coil can be mounted more positively onto a printed board or the like. Meanwhile, this provides a leadless structure, hence mounting with high density can be achieved.

In the array type choke coil of the present embodiment, first coil 601 and second coil 604 are structured by blanking and bending of a metal sheet. Accordingly, as compared to the conventional coil structured by winding a conductor wire and attaching a terminal at a tip of the conductor wire, it is easy to secure an inductance value and low direct-current resistance value required in a high-frequency region with a result that it becomes easy to cope with a large current.

Meanwhile, because a required inductance value can be secured without increasing the number of turns of the coil, it is possible to realize a small-sized short array type choke coil.

First coil 601 and second coil 604 are buried within magnetic material 607. Magnetic material 607 is excellent in insulatability and capable of preventing a short circuit trouble between coils and at coil parts 634 from occurring and realizing a reliable array type choke coil. Particularly, by providing magnetic material 607 containing one or more selected from iron (Fe), nickel (Ni) and cobalt (Co) as a main component of its metal magnetic powder, it is possible to obtain magnetic material 607 having a high saturation magnetic flux density capable of coping with large current and a magnetic characteristic of high magnetic permeability, thus realizing an array type choke coil great in inductance value.

The array type choke coil of the above structure is explained of its operation in the below.

Figure 30:
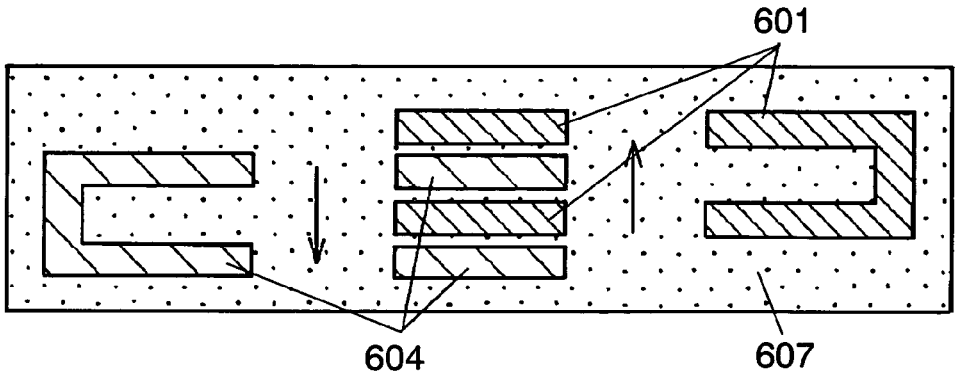
FIG. 30 is a sectional view along the line B4-B4 shown in FIG. 26 of the array type choke coil according to the same embodiment, which is a view showing the case of a positive coupled structure.

First coil 601 and second coil 604 are equal in the number of turns but opposite in winding direction. Accordingly, in case flowing currents through first input terminal 602 and second input terminal 605, the magnetic fluxes extending through the respective coils are opposite in direction due to the generated magnetic field. FIG. 30 is a sectional view along the line B4-B4 in the array type choke coil of the present embodiment shown in FIG. 26, showing the magnetic fluxes extending through the respective coils denoted by the arrows. First coil 601 and second coil 604 have respective in-coil magnetic fluxes opposite in direction, thus providing a positive coupled structure.

Figure 31:
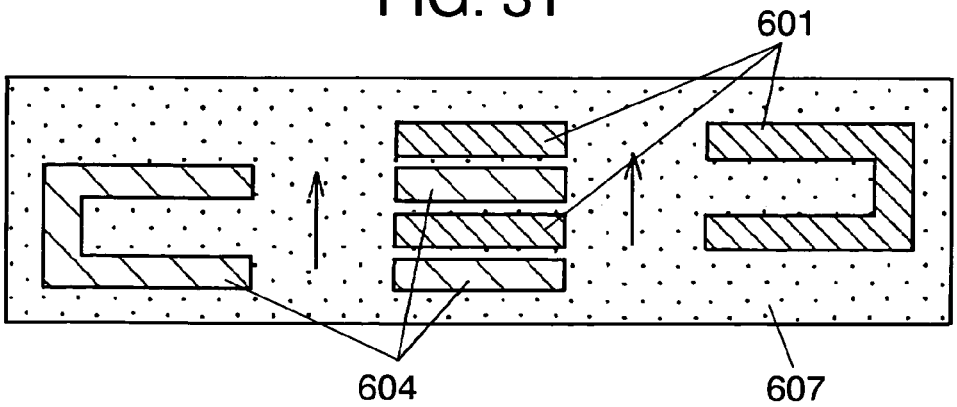
FIG. 31 is a sectional view along the line B4-B4 shown in FIG. 26 of the array type choke coil according to the same embodiment, which is a view in the case of a negative coupled structure.

FIG. 31 is similarly a sectional view along the line B4-B4 in the array type choke coil shown in FIG. 26, showing the magnetic fluxes extending through the respective coils denoted by the arrows. In this case, first coil 601 inputs a current at first input terminal 602 while second coil 604 inputs a current at second output terminal 606. The in-coil magnetic flux of first coil 601 and the in-coil magnetic flux of second coil 604 are the same in direction, thus providing a negative coupled structure.

The array type choke coil in the above structure is explained in its operation in the below.

As shown in FIG. 30, flow of an electric current to first coil 601 causes a magnetic flux. The magnetic flux constitutes a magnetic circuit extending through the inside of first coil 71, to pass outside first coil 71 and return again inside first coil 71. During flow of currents to second coil 604, a magnetic circuit is constituted similarly.

At this time, because first coil 601 and second coil 604 are arranged in a manner partly meshed, there exists a superimposed magnetic flux of among the magnetic fluxes of magnetic circuits caused by flow of currents to first coil 601 and second coil 604. Particularly, the magnetic superimpositions are intensified at around the centers of the respective coils.

Namely, in the magnetic flux caused by flow of a current to first coil 601, there is a magnetic flux extending through a coil inside of second coil 604. Likewise, in the magnetic flux caused by flow of a current to second coil 604, there is a magnetic flux extending through the inside of first coil 601. Because the direction of the magnetic flux extending through the coil inside of first coil 601 and the direction of the magnetic flux extending through the coil inside of first coil 601 upon flow of a current to second coil 604 are the same, these are superimposed together to increase the magnetic flux extending through the coil inside of first coil 601. Because there is a similar superimposition concerning second coil 604, there is an increase of the magnetic flux extending through a coil inside of first coil 601.

This causes a great magnetic field through the array type choke coil, thereby increasing the inductance value furthermore. Accordingly, in case an array type choke coil in positive coupled structure is used as a power supply circuit choke coil 63 shown in FIG. 6 of embodiment 1, the positive-coupled array type choke coil has an increased inductance value, thus suppressing the ripple currents and realizing a power supply circuit capable of coping with a large current in a high-frequency band.

Meanwhile, on the array type choke coil structured shown in FIG. 31, flow of an electric current to the first coil 601 causes a magnetic flux. The magnetic flux constitutes a magnetic circuit extending through the inside of first coil 601, to pass outside first coil 601 and return again to the inside of first coil 601. Furthermore, during flow of a current to second coil 604, a magnetic circuit is constituted similarly. At this time, because first coil 601 and second coil 604 are arranged in a manner partly meshed, there exists a superimposed magnetic flux of among the magnetic fluxes of magnetic circuits caused by flowing currents to first coil 601 and second coil 604. Particularly, the magnetic superimpositions are intensified at around the centers of the respective coils.

As shown in FIG. 31, of the magnetic flux caused by flow of a current to first coil 601, there is a magnetic flux extending through the inside of second coil 604. Likewise, in the magnetic flux caused by flow of a current to second coil 604, there is a magnetic flux extending through the inside of first coil 601.

Because opposite are the direction of the magnetic flux extending through the inside of the coil caused by flow of a current to second coil 604 and the direction of the magnetic flux extending through the inside of second coil 604 caused by flow of a current to first coil 601, there is a decrease in the magnetic flux extending through a coil inside of second coil 604. Similarly, because opposite are the direction of the magnetic flux extending through the inside of coil 601 caused by flow of a current to first coil 601 and the direction of the magnetic flux extending through the coil inside of first coil 601 caused upon flow of a current to second coil 604, there is a decrease in the magnetic flux extending through inside of second coil 604. This can reduce the magnetic field caused through the array type choke coil, thus suppressing the magnetic field from saturating.

Accordingly, in case the negative-coupled array type choke coil is used similarly as a power supply circuit choke coil 63 shown in FIG. 6 of embodiment 1, the direct-current superimposition of choke coil 63 can be increased because magnetic flux saturation can be suppressed, thus realizing a power supply circuit capable of coping with large current.

The inductance value of the array type choke coil is influenced by the coupling state of first coil 601 and second coil 604. The coupling of first coil 601 and second coil 604 changes depending upon the superimposition degree of magnetic-circuit magnetic flux caused by flowing currents to first coil 601 and second coil 604. The superimposition can be changed by the arrangement of first coil 601 and second coil 604.

Accordingly, in case the distance is changed between a coil center point of first coil 601 and a coil center point of second coil 604, the degree of magnetic flux superimposition can be changed. As a result, the inductance value of the array type choke coil can be varied without changing the number of turns of first coil 601 and second coil 604. This can easily obtain the inductance value required in a design.

Hereunder, explanation is made on the relationship between distance between center points and coupling when changing the distance between a coil center point of first coil 601 and a coil center point of second coil 604, on the basis of a concrete example. In the below, first coil 601 and second coil 604 is given an outer diameter of 8.0 mm, an inner diameter of 4.0 mm and a sheet thickness of 0.5 mm while magnetic material 607 is given a size of 10 mm vertically, 16 mm horizontally and 3.5 mm in height.

Figure 32A:
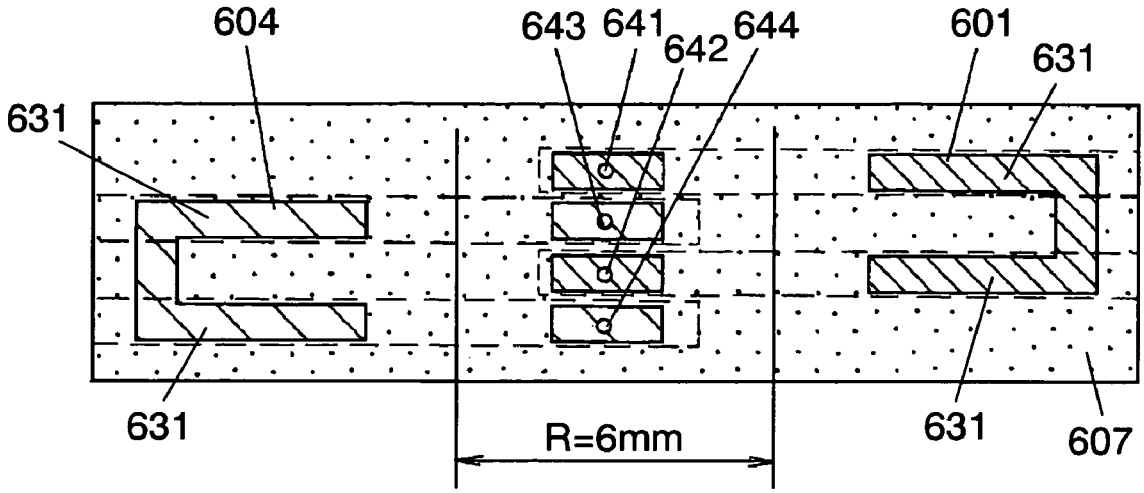
FIG. 32A is a view for explaining a relationship between a distance between coil center points and a coupling in the array type choke coil according to the same embodiment, which is a sectional view of the array type choke coil in a structure with a distance between center points R=6 mm.
Figure 32B:
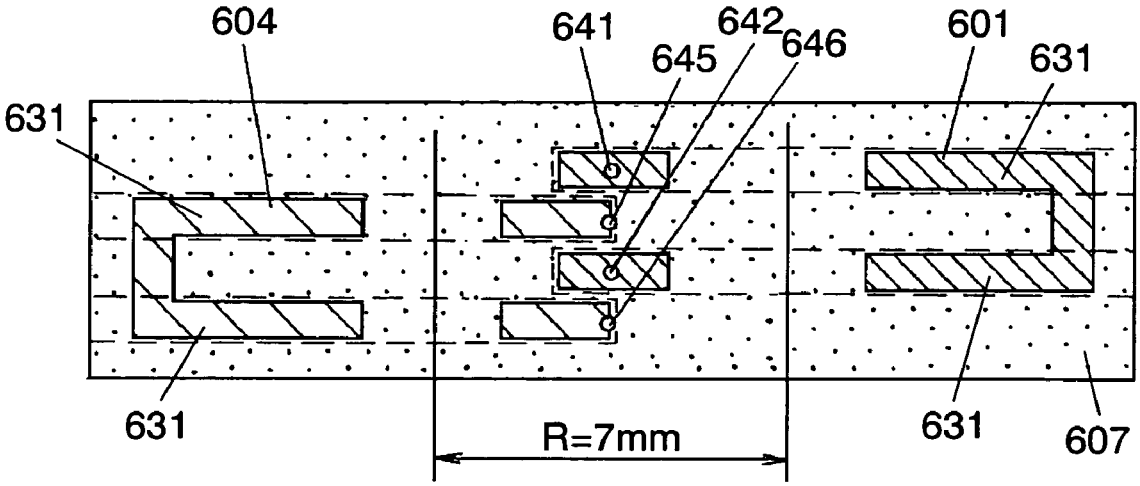
FIG. 32B is the array type choke coil according to the same embodiment, in a sectional view of the array type choke coil in a structure with a distance between center points R=7 mm.
Figure 32C:
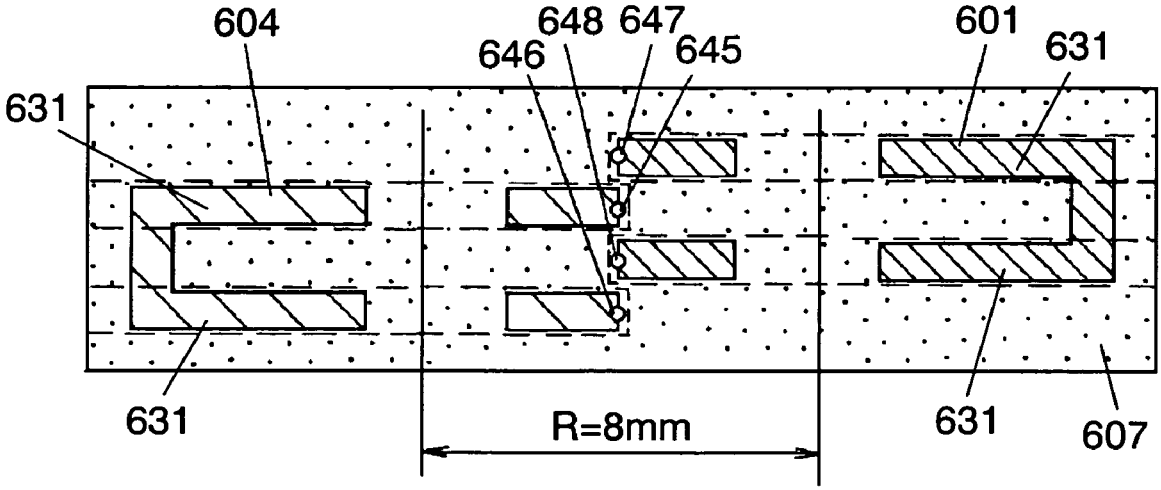
FIG. 32C is the array type choke coil according to the same embodiment, in a sectional view of the array type choke coil in a structure with a distance between center points R=8 mm.
Figure 32D:
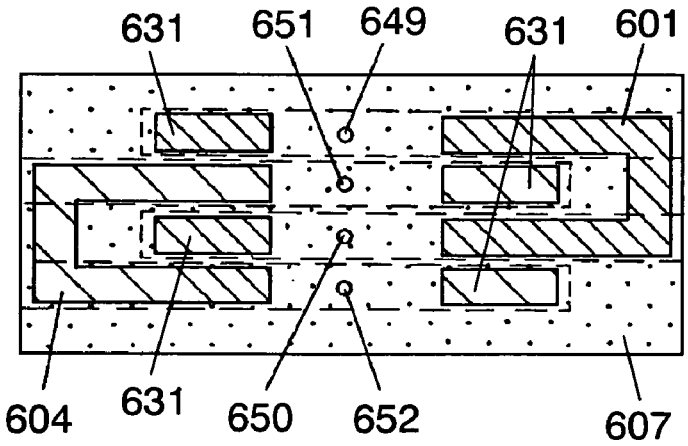
FIG. 32D is the array type choke coil according to the same embodiment, in a sectional view of the array type choke coil in a structure with a distance between center points R=0 mm.

FIG. 32A is a sectional view of an array type choke coil in a structure that distance R between a center point of first coil 601 and a center point of second coil 604 is R=6 mm. FIG. 32B is a similarly sectional view in the case distance R between center points is R=7 mm while FIG. 32C is in the case distance R between center points is R=8 mm. The basic structure of these figures is a structure shown in FIG. 26, assuming a sectional form in a manner extending along the line B4-B4. Meanwhile, FIG. 32D is a sectional view in the case distance R between center points is R=0 mm. In this case, because the entire structure can be made smaller in size, magnetic material 607 is made in a size smaller than the structure shown in FIG. 32A to 32C.

In the array type choke coil in a structure shown in FIG. 32A, concerning a mesh region by two coils, arcuate part 631 of second coil 604 is in mesh between two arcuate parts 631 first coil 601. There is provided an arrangement to put on one line all of the center points of the respective left-sided coil cross-sections of two arcuate parts 631 comprising the coil parts of first coil 601 and all of the center points of the respective right-sided coil cross-sections of two arcuate parts 631 comprising the coil parts of second coil 604. This is achieved because first coil 610 and second coil 604 are both given an outer diameter of 8 mm, an inner diameter of 4 mm and a distance between coil center points of 6 mm, in the coil part.

In the array type choke coil in a structure shown in FIG. 32B, concerning a mesh region by the two coils, arcuate part 631 comprising a coil part of second coil 604 is in mesh with between two arcuate parts 631 comprising coil parts of first coil 601. There is provided an arrangement to put on one line center points 641, 642 of the respective left-sided coil cross-sections of two arcuate parts 631 comprising the coil parts of first coil 601 and outer peripheries 645, 646 of the respective right-sided coil sections of two arcuate parts 631 structuring the coil parts of second coil 604. This is achieved because first coil 610 and second coil 604 are both given an outer diameter of 8 mm, an inner diameter of 4 mm and a distance between coil center points of 7 mm.

In the array type choke coil in a structure shown in FIG. 32C, concerning a mesh region by the two coils, arcuate part 631 comprising a coil part of second coil 604 is partly overlapped between two arcuate parts 631 comprising coil parts of first coil 601. The degree of superimposition is such that there is provided an arrangement to put on one line outer peripheries 647, 648 of the respective left-sided coil sections of two arcuate parts 631 comprising the coil parts of first coil 601 and of outer peripheries 645, 646 of the respective right-sided coil sections of two arcuate parts 631 comprising the coil parts of second coil 604. This is achieved because first coil 610 and second coil 604 are both given an outer diameter of 8 mm, an inner diameter of 4 mm and a distance between coil center points of 8 mm, in the coil part.

In the array type choke coil in a structure shown in FIG. 32D, concerning a mesh region by the two coils, there is provided an arrangement to completely overlap two arcuate parts 631 comprising the coil parts of first coil 601 with two arcuate parts 631 comprising the coil parts of second coil 604. Namely, there is provided an arrangement to put on one line center points 649, 650 of two arcuate parts 631 comprising the coil parts of first coil 601 and center points 651, 652 of two arcuate parts 631 comprising the coil parts of second coil 604. Incidentally, first coil 601 has a coil axis passing center points 649, 650 of these two arcuate parts 631 while second coil 604 similarly has a coil axis passing center points 651, 652 of these two arcuate parts 631. This is because first coil 610 and second coil 604 are both given an outer diameter of 8 mm, an inner diameter of 4 mm and a distance between coil center points is 0 mm.

In the case of the structure of an array type choke coil shown in FIG. 32A, the in-coil magnetic flux caused upon flow of a current to first coil 601 is not shielded by arcuate part 631 of second coil 604. Likewise, the magnetic flux in first coil 601 caused upon flow of a current to second coil 604 is not shielded by arcuate part 631 of first coil 601. Accordingly, in the array type choke coil of this structure, the magnetic path is not blocked by first coil 601 and second coil 604. As a result, it is possible to increase the effective cross-sectional areas of coupling in the respective coils.

The array type choke coil of this structure is achieved not only in the case the coils in mesh are quite equal in outer diameter and inner diameter but also in the case the respective differences between outer and inner diameters of the coils in mesh are equal. For example, if the coil part of first coil 601 has an outer diameter of 9 mm and an inner diameter of 7 mm while the coil part of second coil 604 has an outer diameter of 8 mm and an inner diameter of 6 mm, the distance between a coil center point of first coil 601 and a coil center point of second coil 604, if made 6.5 mm, can realize a highly-coupled array type choke coil as above.

Incidentally, in the array type choke coil shown in FIG. 32A, the distance between the center point of first coil 601 and center point of second coil 604 was set such that respective center points 641, 642 of the left-sided cross-sections of two arcuate parts 631 comprising coil parts of first coil 601 and respective center points 643, 644 of the right-sided coil-sections of two arcuate parts 631 comprising coil parts of second coil 604 are all aligned on one line. However, such setting is not necessarily required; i.e., it is satisfactory to make an alignment to a degree to sufficiently secure an effective cross-sectional area of in-coil coupling.

In the structure of the array type choke coil structure shown in FIG. 32B, the in-coil magnetic flux of second coil 604 caused upon flow of a current to first coil 601 is partly shielded by arcuate part 631 of the coil part of second coil 604. Likewise, the in-coil magnetic flux of first coil 601 caused upon flow of a current to second coil 604 is partly shielded by arcuate part 631 of the coil part of first coil 601. As a result, in the array type choke coil of this structure, there are caused portions where magnetic paths are blocked respectively by first coil 601 and second coil 604. Accordingly, coupling can be suppressed as compared to the array type choke coil in a structure shown in FIG. 32A.

In the structure of the array type choke coil structure shown in FIG. 32C, the in-coil magnetic flux of second coil 604 caused upon flow of a current to first coil 601 is partly shielded by arcuate part 631 of the coil part of second coil 604. Likewise, the in-coil magnetic flux of first coil 601 caused upon flow of a current to second coil 604 is partly shielded by arcuate part 631 of the coil part of first coil 601. As a result, in the array type choke coil of this structure, there are caused portions where magnetic paths are blocked respectively by first coil 601 and second coil 604. Accordingly, coupling can be suppressed furthermore as compared to the array type choke coil in a structure shown in FIG. 32A or FIG. 32B.

In the structure of the array type choke coil structure shown in FIG. 32D, because there is provided an arrangement such that the coil parts of first coil 601 and second coil 604 have the same axis, size reduction as well as strengthening of the coupling is possible.

As described above, by changing the distance R between the coil center point of first coil 601 and the coil center point of second coil 604, the effective cross-sectional area of coupling in the coil can be adjusted as well as the coupling degree. Accordingly, it is possible to adjust the total coupling of the array type choke coil more freely. This can easily realize an array type choke coil having the inductance value required in a design.

EMBODIMENT 6

Figure 33A:
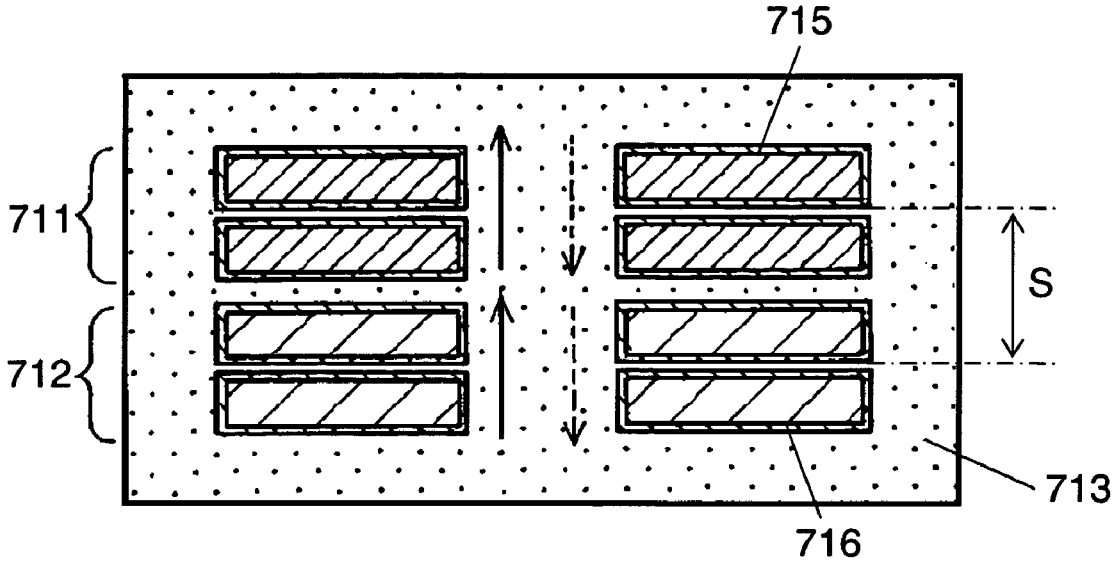
FIG. 33A is a sectional view showing a coil part structure of an array type choke coil according to embodiment 6 of the present invention.
Figure 33B:
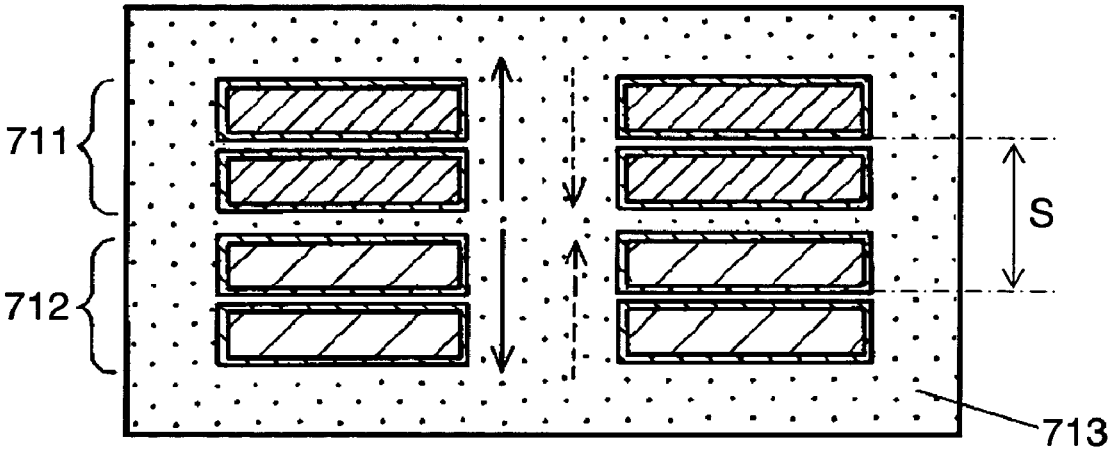
FIG. 33B is the array type choke coil according to the same embodiment, in a sectional view showing similarly a coil part structure.

FIGS. 33A and 33B are sectional views showing a structure of a coil part of an array type choke coil according to embodiment 6 of the present invention. This is a structure that two terminal-integrated type coils 711, 712 are vertically arranged and buried within magnetic material 713. Note that, in the figures, magnetic field direction is shown by the dotted-lined arrow while current direction is shown by the solid-lined arrow.

The array type choke coil in the structure shown in FIG. 33A is structured that the respective coil parts 715, 716 of two terminal-integrated type coils 711, 712 are vertically arranged and wherein currents are inputted at terminals such that the in-coil magnetic fields caused upon flow of a current are in the same direction. This structure is positive coupling. By this structure, the occurring magnetic fluxes are in the same direction. Because the respective magnetic fluxes are superimposed, inductance value can be increased and the array type choke coil can be reduced in size.

Incidentally, similar effect is obtainable on three or more terminal-integrated type coils if arranged similarly and inputted by currents through terminals in a similar manner such that in-coil magnetic fields caused upon flow of a current are in the same direction.

An array type choke coil in a structure shown in FIG. 33B is structured that similarly two terminal-integrated type coils 711, 712 are vertically arranged to input a current from a terminal such that in-coil magnetic fields caused upon flow of a current are in opposite directions respectively. This structure is negative coupling. Because the magnetic fluxes caused are cancelled from each other by this structure, it is possible to suppress against magnetic flux saturation and enhance the direct-current superimposition characteristic of the array type choke coil.

Incidentally, similar effect is obtainable on three or more terminal-integrated type coils if arranged similarly and currents are inputted through terminals in a similar manner, such that in-coil magnetic fields caused upon flow of a current are alternate in direction.

Figure 34:
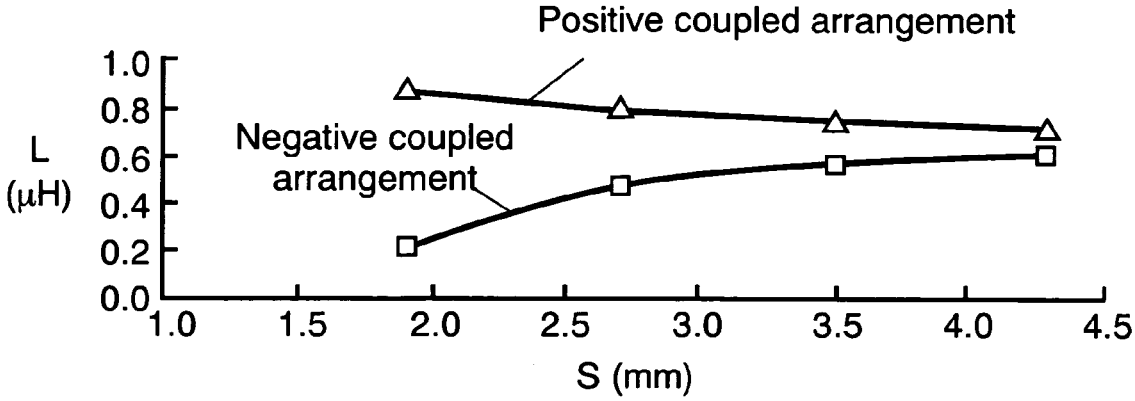
FIG. 34 is the array type choke coil according to the same embodiment, in a figure showing a relationship between the distance between coil center points S and an inductance.

Concerning an array type choke coil in such a positive coupled structure and negative coupled structure, explanation is made on a relationship between distance S between center points of two terminal-integrated type coils 711, 712 and an inductance value. FIG. 34 is a relationship between distance S between center points and inductance value L. This result was determined on the assumption that terminal-integrated type coil 711, 712 have a size of an inner diameter of 4.2 mm, an outer diameter of 7.9 mm, a height of 1.7 mm and the number of turns of 3 turns while a core formed of magnetic material 713 have a magnetic permeability of $\mu$=26 and a size in vertical, horizontal and height of 10 mm, 10 mm and 3.5 mm, respectively. Inductance value L was set to be L=0.595 μH.

In the case of distance S between center points of S=3.5 mm, the array type choke coil in a positive coupled structure had inductance value L of L=0.747 μH while the array type choke coil in a negative coupled structure had inductance value L of L=0.560 μH smaller by 24.9% than the case of the positive coupled structure.

Similarly, in the case that distance S between center points was given S=2.7 mm, the array type choke coil in a positive coupled structure had inductance value L of L=0.794 μH while the array type choke coil in a negative coupled structure had inductance value L of L=0.468 μH smaller by 41.0% than the case of the positive coupled structure.

From the above result, it was found that, if distance S between center points is equal, inductance value L is greater on the array type choke coil in a positive coupled structure than on the array type choke coil in a negative coupled structure.

Meanwhile, in the case of changing distance S between center points in a positive coupled structure, L=0.747 μH was obtained at S=3.5 mm for example while L=0.794 μH was obtained at S=2.7 mm. This value is 6.3% greater than inductance value L at S=3.5 mm. Likewise, in the case of changing distance S between center points in a negative coupled structure, L=0.560 μH was obtained at S=3.5 mm for example while L=0.468 μH was obtained at S=2.7 mm. This value is 16.6% smaller than inductance value L at S=3.5 mm.

From the above result, in the case of a positive coupled structure, inductance value L can be increased by arranging the coils in a manner so as to shorten distance S between center points. Meanwhile, in the case of a negative coupled structure, inductance value can be decreased by arranging the coils in a manner so as to shorten distance S between center points. Accordingly, without changing the number of turns of the terminal-integrated type coil 711, 712, inductance value L of an array type choke coil can be arbitrarily set to a certain extent by adjusting distance S between center points.

Although explanation was made on the case with two terminal-integrated type coils 711, 712, the inductance value of an array type choke coil can be comparatively easily changed by adjusting the respective distances between center points in the case where three or more terminal-integrated type coils are used.

Figure 35:
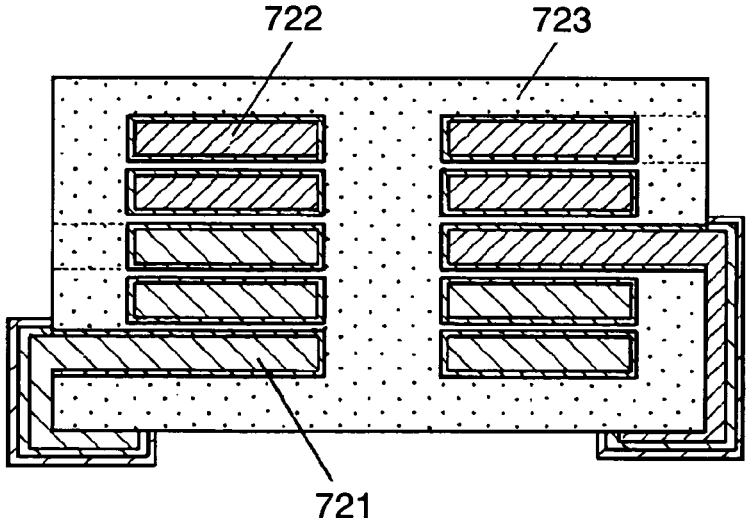
FIG. 35 is a sectional view of an array type choke coil in a modification of the array type choke coil according to the same embodiment.

FIG. 35 is a sectional view showing a modification to the array type choke coil of the present embodiment. The array type choke coil of this modification is a sectional view showing an arrangement structure of terminal-integrated type coils 721, 722 having the number of turns of (N+0.5, where N is a natural number equal to or greater than 1), of among the array type choke coils arranging terminal-integrated type coils in positive and negative couplings. Terminal-integrated type coils 721, 722 are vertically stacked and buried within magnetic material 723. In FIG. 35, the terminal-integrated type coils respectively have the number of turns of 2.5 turns, wherein 2.5 turns of coil 722 is stacked on the right side of the 2 turns of coil 721. Meanwhile, 2 turns of coil 722 is stacked on the left side of the 2.5 turns of coil 721. This structure can realize an array type choke coil small in size and short in structure because of the capability to eliminate useless space and stack coils with density.

In the below, explanation is made on the coil arrangement and the direction of exposing input and output terminals of the array type choke coil in the present embodiment like this.

Figure 36A:
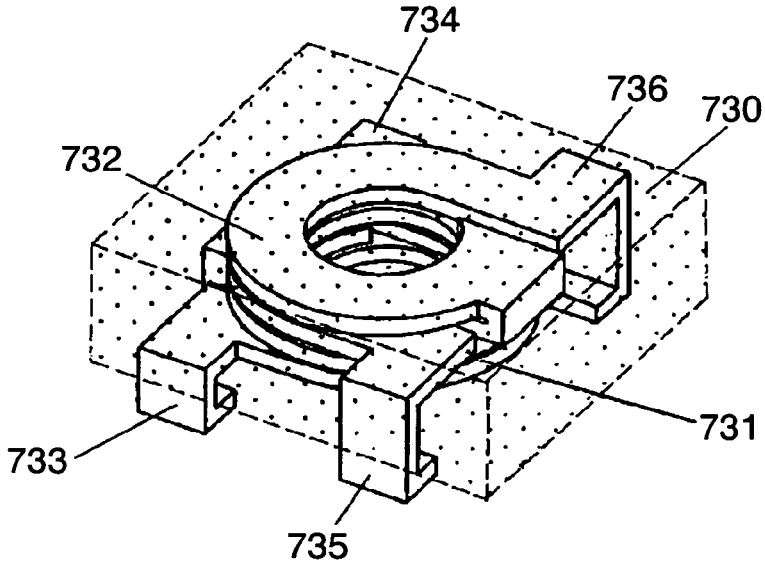
FIG. 36A is a projection perspective view of an array type choke coil in another modification of the array type choke coil according to the same embodiment.
Figure 36B:
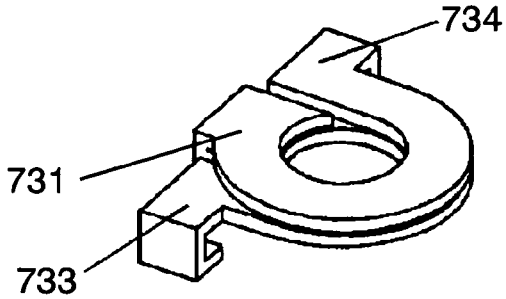
FIG. 36B is a perspective view of a terminal-integrated type coil to be used in the array type choke coil according to the another modification.
Figure 36C:
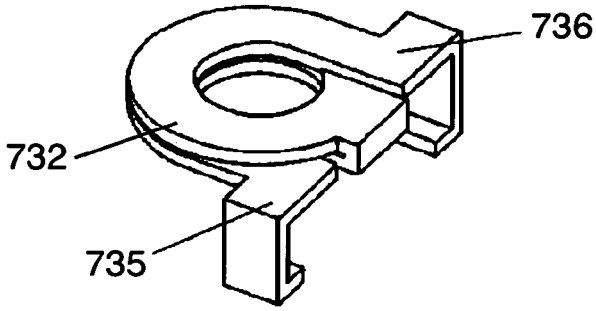
FIG. 36C is a perspective view of a terminal-integrated type coil to be used in the array type choke coil according to the another modification.
Figure 36D:
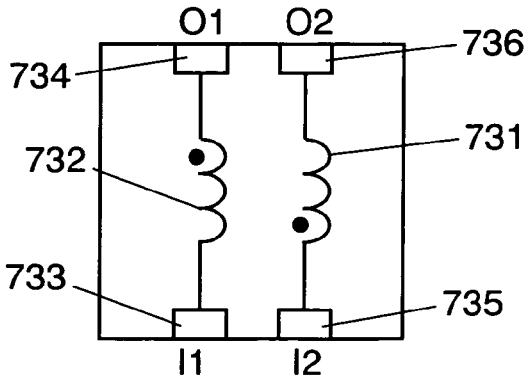
FIG. 36D is a wiring diagram of the array type choke coil of the another modification.

FIG. 36A is a projection perspective view showing a structure that terminal-integrated type coil 731 shown in FIG. 36B and terminal-integrated type coil 732 shown in FIG. 36C are vertically arranged within magnetic material 730 in a rectangular prism form. FIG. 36D is a wiring diagram of the same. Two coils 731, 732 respectively have the number of turns of 1.5 turns, having respective input terminals 733, 735 and respective output terminals 734, 736.

As understood from FIG. 36A, input terminal 733 of coil 731 and input terminal 735 of coil 732 are exposed at the same surface, while output terminal 734 of coil 731 and output terminal 736 of coil 732 are exposed at of the surface opposite to the above surface.

This arrangement can allow each of input terminals 733, 735 and output terminals 734, 736 to be exposed at of the same surface. Accordingly, when mounting an array type choke coil onto a printed board, arrangement is facilitated in a circuit structure with a semiconductor integrated circuit, etc, thus improving mounting density.

Meanwhile, it is easy to provide an indication, such as IN at input side and OUT at output side. Although this modification had the number of turns of 1.5 turns on two coils 731, 732, the similar effect is obtainable with the number of turns of 2.5 turns, 3.5 turns or the like.

Note that there is not always a need to expose all the input or output terminals out of one surface, i.e., at least two of the input and output terminals maybe exposed at one surface. Meanwhile, when exposing all the input and output terminals at the same surface, the input and output terminals may be exposed alternately.

Figure 37A:
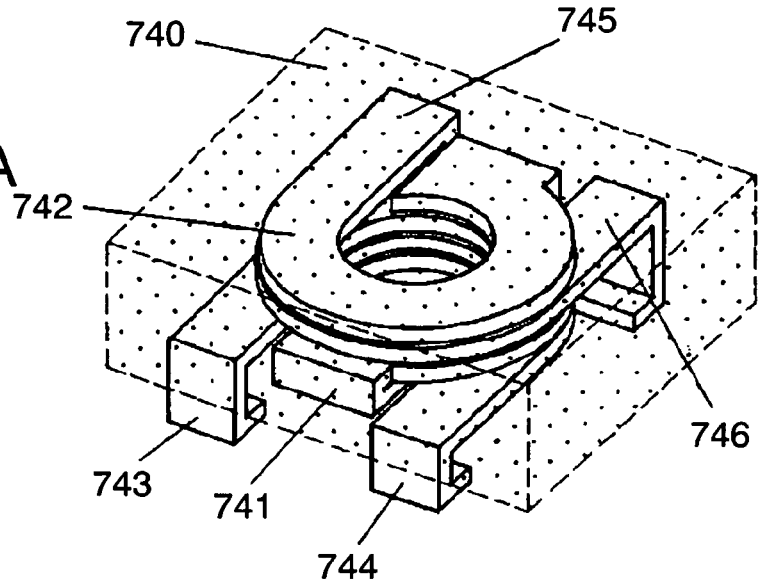
FIG. 37A is a projection perspective view of an array type choke coil in still another modification of the array type choke coil according to the same embodiment.
Figure 37B:
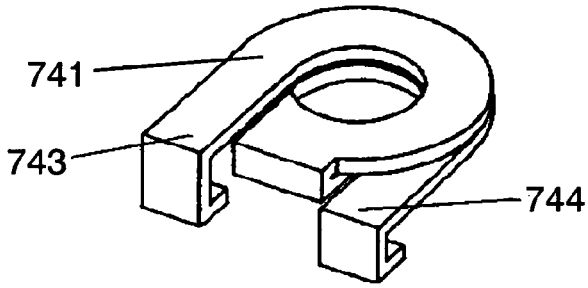
FIG. 37B is a perspective view of a terminal-integrated type coil to be used in the array type choke coil according to the still another modification.
Figure 37C:
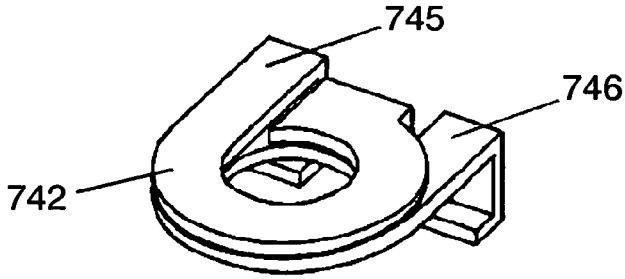
FIG. 37C is a perspective view of a terminal-integrated type coil to be used in the array type choke coil according to the still another modification.
Figure 37D:
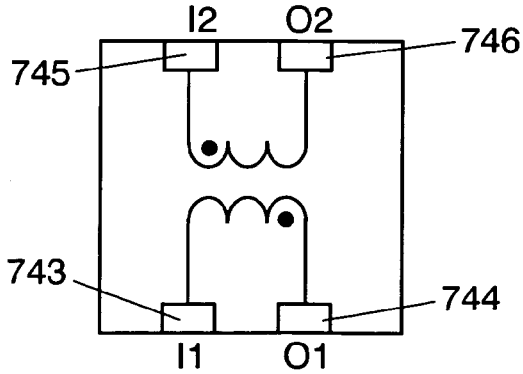
FIG. 37D is a wiring diagram of the array type choke coil of the still another modification.

FIG. 37A is a projection perspective view of an array type choke coil in another structure. This array type choke coil is in a structure vertically arranging terminal-integrated type coil 741 shown in FIG. 37B and terminal-integrated type coil 742 shown in FIG. 37C. FIG. 37D is a wiring diagram of the same. In the case of this array type choke coil, input terminal 743 and output terminal 744 of one coil 741 are exposed at the same surface of magnetic material 740 while input terminal 745 and output terminal 746 of the other coil 742 are exposed at the surface opposite to the above surface.

In this structure, the coils are not limited to two in the number but three or more coils may be stacked similarly.

Figure 38A:
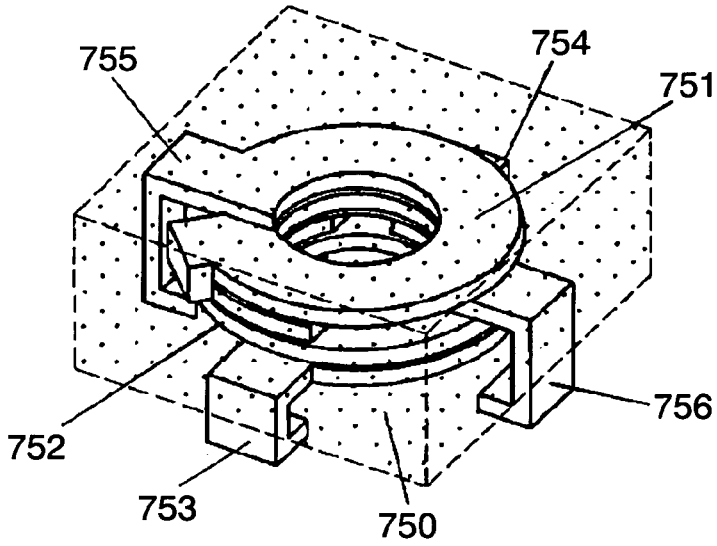
FIG. 38A is a projection perspective view of an array type choke coil in yet another modification of the array type choke coil according to the same embodiment.
Figure 38B:
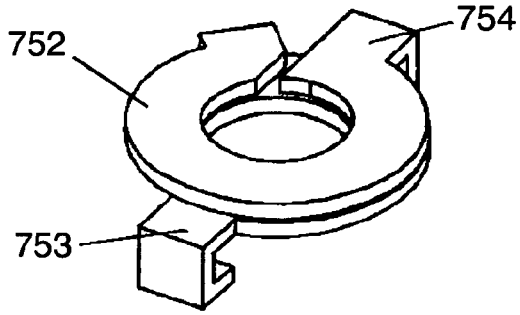
FIG. 38B is a perspective view of a terminal-integrated type coil to be used in the array type choke coil according to the yet another modification.
Figure 38C:
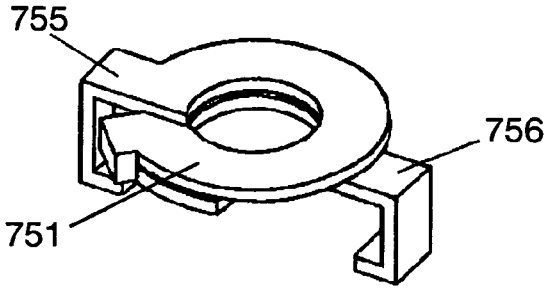
FIG. 38C is a perspective view of a terminal-integrated type coil to be used in the array type choke coil according to the yet another modification.
Figure 38D:
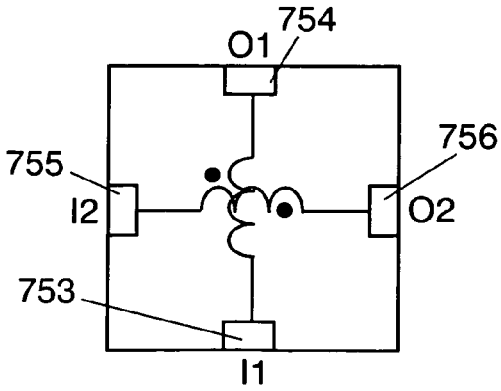
FIG. 38D is a wiring diagram of the array type choke coil of the yet another modification.

FIG. 38A is a projection perspective view of an array type choke coil in another structure. This array type choke coil is in a structure vertically arranging terminal-integrated type coil 751 shown in FIG. 38B and terminal-integrated type coil 752 shown in FIG. 38C. FIG. 38D is a wiring diagram of the same. In the case of this array type choke coil, respective coils 751, 752 having the number of turns of 1.5 turns are buried in a wiring structure shown in FIG. 38D within magnetic material 750. Namely, coil 751 has input terminal 755 and output terminal 756 while coil 752 has input terminal 753 and output terminal 754. Coil 751 and coil 752 are arranged to expose the respective input terminal 753, 755 and the respective output terminal 754, 756 out of different surfaces.

This structure prevents the terminals from contacting one with another even if the input and output terminals are increased in area. Accordingly, the mounting on or heat dissipation to a printed board can be improved furthermore, and further the terminals can be lowered in resistance value, hence realizing an array type choke coil coping with current increase.

Meanwhile, because this structure can evenly disperse the terminal soldering points, mounting strength can be increased.

In the array type choke coil of this structure, the coils are not limited to two in the number but three or more coils may be stacked in a similar way. In such a case, arrangement is possible to allow a plurality of terminals to be exposed at the same surface.

Although the magnetic material was explained as in a rectangular prism form, chamfering may be made to facilitate directional determination or indications may be provided indicating input and output terminals.

As described above, the array type choke coil of the present embodiment can secure a required inductance value in a high-frequency band, hold a small direct-current resistance value, and cope with large current, thus being reduced in size. Accordingly, the use on a power supply circuit as explained in FIG. 6 of embodiment 1 can realize a power supply circuit small in size and high in performance. This power supply circuit is preferably mounted on an electronic apparatus such as a personal computer or a cellular phones, enabling size reduction.

EMBODIMENT 7

Figure 39:
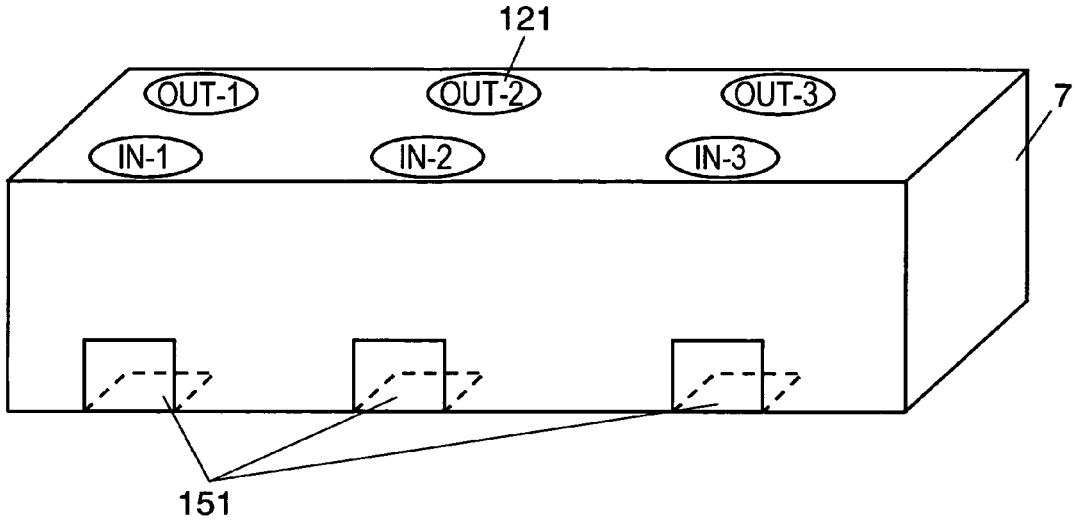
FIG. 39 is an exterior perspective view of an array type choke coil according to embodiment 7 of the present invention.
Figure 40:
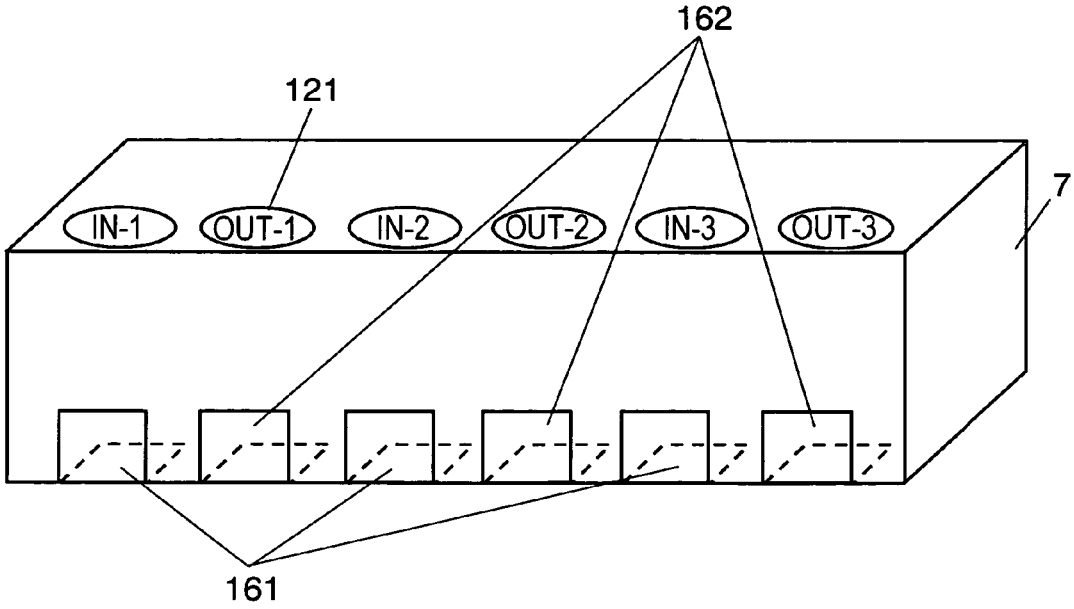
FIG. 40 is an exterior perspective view showing another structure of an array type choke coil according to embodiment 7 of the present invention.
Figure 41:
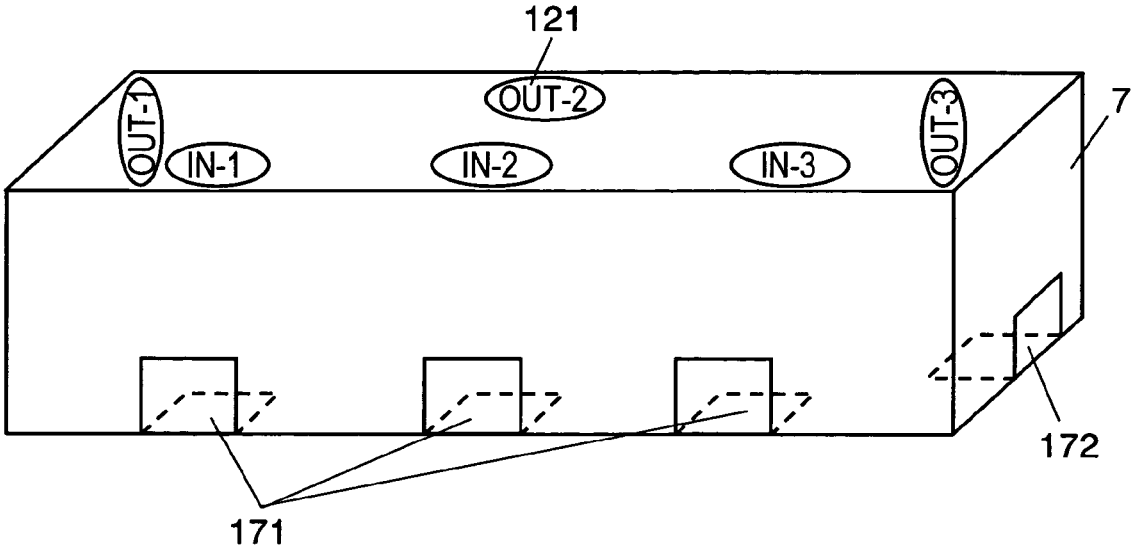
FIG. 41 is an exterior perspective view showing still another structure of an array type choke coil according to embodiment 7 of the present invention.

An array type choke coil in embodiment 7 of the present invention is explained while referring to FIGS. 39 to 41. The array type choke coil of this embodiment is similar in basic structure to the array type choke coil explained in embodiment 1 to 6. FIGS. 39 to 41 shows an exterior view of the array type choke coil, wherein terminal-integrated type coils are shown at input and output terminals only.

The array type choke coil shown in FIG. 39 is characterized by a structure that all input terminals 151 are exposed out of one surface of magnetic material 7 in a rectangular prism form while output terminals (not shown) are all exposed out of the surface opposite to the one surface. Due to this, when the array type choke coil is mounted onto a printed board, it can be arranged close to a semiconductor integrated circuit or the like, thus making it possible to enhance the mounting density on a printed board. On the top surface of magnetic material 7, there is provided indication area 121 where IN-1, IN-2, IN-3, etc. are written by printing or the like as indications representative of input terminals 151, and OUT-1, OUT-2, OUT-3, etc. as indications representative of output terminals. Due to this, it is easy to easily confirm in mounting onto a printed board for example or after mounting whether an array type choke coil has been mounted correctly.

Incidentally, structure may be that input and output terminals are all exposed out of one surface. For example, input terminals 161 and output terminals 162 may be alternately arranged and exposed as shown in FIG. 40. In this case, on the top surface of magnetic material 7, there is provided indication area 121 where IN-1, IN-2, IN-3, etc. are indicated in respective corresponding positions by printing or the like as indications representative of input terminals 151, and OUT-1, OUT-2, OUT-3, etc. as indications representative of output terminals 162. Due to this, it is easy to easily confirm in mounting onto a printed board for example or after mounting whether an array type choke coil has been mounted correctly.

There is not necessarily a need to expose all input terminals 161 and output terminals 162 out of one surface. At least two terminals selected from two or more input and output terminals may be exposed out of one surface.

In the case of a terminal-integrated type coil having the number of turns of N turns (N is an integer equal to or greater than 1), the structure is that the input and output terminals project at the upper and lower positions in the same direction. The input and output terminals, in upper-and-lower sets as they are, may respectively be arranged on one surface.

Furthermore, coil arrangement is possible such that at least two terminals are exposed in respective different directions. For example, the array type choke coil shown in FIG. 41 is structured that three output terminals 172 are exposed at respective different surfaces while three input terminals 171 are all exposed at the same surface. In the case of this array type choke coil, on the top surface of magnetic material 7, there is provided indication area 121 where IN-1, IN-2, IN-3, etc. are written in respective corresponding positions by printing or the like as indications representative of input terminals 171, and OUT-1, OUT-2, OUT-3, etc. as indications representative of output terminals 172. Due to this, it is easy to easily confirm in mounting onto a printed board for example or after mounting whether an array type choke coil has been mounted correctly.

Although the above structure explains the case using terminal-integrated type coils three in the number, there is no limitation in the number of terminal integrated type coils. There is no limitation also in the direction in which terminals are to be taken out. It is satisfactory if exposure is done in the plane in the direction in which terminals are to be exposed.

In this manner, in the case of a terminal-integrated type coil arrangement having terminals exposed an arbitrary plane, it is possible to increase the distance between terminals. This can increase terminal area and hence improve heat dissipation characteristic furthermore. Because the terminal can be reduced in resistance value, it is possible to realize an array type choke coil that is suited to current increase. Because the terminal soldering points are dispersed in the bottom and its vicinity by such a structure, mounting strength can be increased against force in each direction. Incidentally, although the magnetic material was in a rectangular prism form in the present embodiment, a corner may be removed from a side in a part or indications may be further provided on the respective terminals.

INDUSTRIAL APPLICABILITY

The array type choke coil of the present invention is structured by fabricating terminal-integrated type coils through bending a blanked sheet formed by etching, blanking or the like a metal sheet, and burying within a magnetic material the terminal-integrated type coils in plurality so as to have a predetermined positional relationship. Because it can be used in a high-frequency band and a required inductance value can be secured and a small direct-current resistance value can be held, it is useful for various electronic apparatuses, particularly in the area of portable apparatuses such as cellular telephone.

The invention claimed is:

1. An array type choke coil characterized by comprising:

a coil group arranging a plurality of terminal-integrated type coils formed by bending a metal sheet and having a set positional relationship, the metal sheet including:

a plurality of arcuate parts;

a connection joining the arcuate parts;

ends extending respectively from the arcuate parts disposed at both ends of the plurality of arcuate parts, an insulation film being formed over a surface of the plurality of arcuate parts, the plurality of terminal-integrated type coils being formed by bending the metal sheet at the connection; and a magnetic material burying therein the coil group.

2. An array type choke coil according to claim 1, wherein the coil group structure arranges the axes of coil constituting the coil group in parallel, where the center point of at least one coil selected from the plurality of coils and the center point of a coil other than the selected coil are in a staggered arrangement.

3. An array type choke coil according to claim 2, wherein a predetermined inductance value is obtained by changing the distance between the center point of at least one coil selected from the coil group and a center point of at least one coil selected from the plurality of coils other than the selected coil.

4. An array type choke coil according to claim 2, wherein a predetermined inductance value is obtained by changing the height of a center point of at least one coil selected from the coil group and a center point of at least one coil selected from the plurality of coils other than the selected coil.

5. An array type choke coil according to claim 2, wherein at least one coil selected from the coil group and both coils immediately adjacent to the selected coil are in a V-form or inverted V-form arrangement, to make a direction of magnetic flux extending through the coil caused upon flow of a current to the selected coil and a direction of magnetic flux extending through the coil caused upon flow of a current to the two coils arranged immediately adjacent different in direction from each other.

6. An array type choke coil according to claim 2, wherein at least one coil selected from the coil group and both coils immediately adjacent to the selected coil are in a V-form or inverted V-form arrangement, to make a direction of a magnetic flux caused upon flow of a current to the selected coil and a direction of magnetic flux caused upon flow of a current to the two coils arranged immediately adjacent the same in direction.

7. An array type choke coil according to claim 2, wherein the coils constituting the coil group have the number of turns of(N+0.5) turns (where N is an integer equal to or greater than 1), to provide an arrangement structure stacking an N-turn portion of the coil selected from the coil group and an (N+0.5)-turn portion of the coil immediately adjacent to the selected coil.

8. An array type choke coil according to claim 5, wherein a predetermined inductance value is obtained by changing respective distances between a center point of the coil selected and center points of the both coils arranged immediately adjacent.

9. An array type choke coil according to claim 1, wherein the coil group arranges the coils such that center points of the plurality of coils constituting the coil group are on a same plane.

10. An array type choke coil according to claim 9, wherein a predetermined inductance value is obtained by changing the distance between center points of two coils immediately adjacent among the plurality of coils.

11. An array type choke coil according to claim 9, wherein the coil group is arranged such that magnetic fluxes in the coils caused upon flow of currents to the plurality of coils alternate in direction.

12. An array type choke coil according to claim 9, wherein the coil group is arranged such that magnetic fluxes in the coils caused upon flow of currents to the plurality of coils are same in direction.

13. An array type choke coil according to claim 1, wherein the coil group structure arranges the axes of coils constituting the coil group in parallel, having a distance between the center point of at least one coil selected from the plurality of coils and the center point of a coil immediately adjacent to the selected coil is half or smaller than the sum of the outer diameter of the selected coil and the diameter of the adjacent coil, wherein at least one turn portion of the selected coil is arranged in a manner meshing with the adjacent coil.

14. An array type choke coil according to claim 13, wherein the selected coil and the adjacent coil have the number of turns of N turn (where N is an integer equal to or greater than 2), to provide an arrangement such that (N−1) turn portion of the adjacent coil is in mesh with the selected coil.

15. An array type choke coil according to claim 13, wherein the coil group is arranged such that the difference between the outer diameter and the inner diameter of the selected coil and a difference between the outer diameter and the inner diameter of the adjacent coil are equal, and the distance between the center point of the selected coil and the center point of the adjacent coil coincides with half of the sum of the outer diameter of the selected coil and the inner diameter of the adjacent coil.

16. An array type choke coil according to claim 13, wherein a predetermined inductance value is obtained by changing the distance between the center point of at least one coil selected from the coil group and the center point of a coil adjacent to the selected coil.

17. An array type choke coil according to claim 13, wherein the coil group is arranged such that the direction of magnetic flux in a coil of upon flow of a current to at least one coil selected from the coil group and the direction of magnetic flux upon flow of a current to a coil adjacent the selected coil are same in direction.

18. An array type choke coil according to claim 13, wherein the coil group is arranged such that the direction of magnetic flux in a coil of upon flowing a current to at least one coil selected from the coil group and the direction of magnetic flux upon flow of a current to a coil adjacent the selected coil are different.

19. An array type choke coil according to claim 9, wherein the coil group structure arranges the plurality of coils all in line.

20. An array type choke coil according to claim 1 wherein at least one coil selected from the plurality of coils is arranged in a position deviated from the other coils arranged in line.

21. An array type choke coil according to claim 1 wherein the coil group is arranged such that selected two or more input terminals or selected two or more output terminals or both are arranged exposed at a same surface.

22. An array type choke coil according to claim 1, wherein the coil group has the plurality of coils constituting the coil group buried within the magnetic material.

23. An array type choke coil according to claim 22, wherein a predetermined inductance value is obtained by changing the intervals between the plurality of coils.

24. An array type choke coil according to claim 22, wherein the coil group is arranged such that magnetic fluxes in the coils caused upon flow of currents to the plurality of coils are in the same direction.

25. An array type choke coil according to claim 22, wherein the coil group is arranged such that magnetic fluxes in the coils caused upon flow of currents to the plurality of coils alternately in direction.

26. An array type choke coil according to claim 22, wherein the plurality of coils have the number of turns of (N+0.5) turns (where N is an integer equal to or greater than 1), to provide an arrangement structure where coils in upper and lower positions have respective 0.5 turn portions lying on a same plane.

27. An array type choke coil according to claim 22, wherein all of the input terminals or all of the output terminals of the plurality of coils or both are exposed at the same surface.

28. An array type choke coil according to claim 1 wherein the magnetic material is formed from at least one of the group consisting of a ferrite magnetic material, a composite of a ferrite magnetic powder and an insulating resin and a composite of a metal magnetic powder and an insulating resin.

29. An array type choke coil according to claim 1 wherein the coil group includes terminal portions which are exposed at the surface have an underlying layer containing nickel (Ni), and an uppermost layer which is formed of a solder layer or thin (Sn) layer.

30. An array type choke coil according to claim 1 wherein the magnetic material is formed in a rectangular prism form, and each of the ends of the plurality of coils is bent to form a terminal extending alone a line from a side of the magnetic material parallel with a center axis of each of the plurality of coils to a bottom of the magnetic material perpendicular to the center axis of each of the plurality of coils.

31. An electronic apparatus characterized by mounting an array type choke coil according to claim 1.

32. An array type choke coil according to claim 13, wherein the coil group structure arranges the plurality of coils all in line.

33. An array type choke coil according to claim 1, wherein a line segment connecting center points of the plurality of arcuate parts joined by the connection is perpendicular to a bend centerline of the connection joining the plurality of arcuate parts.

* * * * *